US008016033B2

(12) United States Patent
Iblings et al.

(10) Patent No.: US 8,016,033 B2
(45) Date of Patent: Sep. 13, 2011

(54) CONTINUOUS FLOW DRILLING SYSTEMS AND METHODS

(75) Inventors: David Iblings, Houston, TX (US); Thomas F. Bailey, Houston, TX (US); Ram K. Bansal, Houston, TX (US); Adrian Steiner, Calgary (CA); Michael Lynch, Houston, TX (US); Simon J. Harrall, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 114 days.

(21) Appl. No.: 12/180,121

(22) Filed: Jul. 25, 2008

(65) Prior Publication Data

US 2009/0025930 A1 Jan. 29, 2009

Related U.S. Application Data

(60) Provisional application No. 60/952,539, filed on Jul. 27, 2007, provisional application No. 60/973,434, filed on Sep. 18, 2007.

(51) Int. Cl.
*E21B 7/00* (2006.01)
*E21B 33/00* (2006.01)
*E21B 34/00* (2006.01)

(52) U.S. Cl. ..... 166/244.1; 166/192; 166/54

(58) Field of Classification Search ..... 166/319, 166/316, 66.4, 244.1, 192, 54; 251/30.01; 137/155; 81/57.15, 57.19, 57.21
See application file for complete search history.

(56) References Cited

U.S. PATENT DOCUMENTS

| | | | | |
|---|---|---|---|---|
| 916,268 | A | 3/1909 | Cameron | |
| 1,491,986 | A | 4/1924 | Greene | |
| 2,102,555 | A | 12/1937 | Dyer | |
| 2,158,356 | A * | 5/1939 | Dyer | 137/515.5 |

(Continued)

FOREIGN PATENT DOCUMENTS

EP 0 116 443 8/1984

(Continued)

OTHER PUBLICATIONS

PCT Search Report from Application No. PCT/US2008/071261 dated Feb. 16, 2009.

(Continued)

*Primary Examiner* — David J Bagnell
*Assistant Examiner* — James G Sayre
(74) *Attorney, Agent, or Firm* — Patterson & Sheridan, L.L.P.

(57) ABSTRACT

In one embodiment, a method for drilling a wellbore includes injecting drilling fluid into a top of a tubular string disposed in the wellbore at a first flow rate. The tubular string includes: a drill bit disposed on a bottom thereof, tubular joints connected together, a longitudinal bore therethrough, and a port through a wall thereof. The drilling fluid exits the drill bit and carries cuttings from the drill bit. The cuttings and drilling fluid (returns) flow to the surface via an annulus defined between the tubular string and the wellbore. The method further includes rotating the drill bit while injecting the drilling fluid; remotely removing a plug from the port, thereby opening the port; and injecting drilling fluid into the port at a second flow rate while adding a tubular joint or stand of joints to the tubular string. The injection of drilling fluid into the tubular string is continuously maintained between drilling and adding the joint or stand to the drill string. The method further includes remotely installing a plug into the port, thereby closing the port. The first and second flow rates may be substantially equal or different.

27 Claims, 30 Drawing Sheets

U.S. PATENT DOCUMENTS

| | | | | |
|---|---|---|---|---|
| 2,202,192 | A | 5/1940 | Cypher | |
| 2,224,657 | A | 12/1940 | Rodgers | |
| 2,239,586 | A | 4/1941 | Appleby | |
| 2,858,838 | A | 11/1958 | Scaramucci | |
| 3,036,590 | A | 5/1962 | Knox | |
| 3,123,157 | A | 3/1964 | Graham | |
| 3,268,017 | A | 8/1966 | Yarbrough | |
| 3,298,385 | A | 1/1967 | Jackson et al. | |
| 3,497,020 | A | 2/1970 | Kammerer, Jr. et al. | |
| 3,559,739 | A | 2/1971 | Hutchison | |
| 3,684,318 | A | 8/1972 | Eckert et al. | |
| 4,310,050 | A | 1/1982 | Bourgoyne, Jr. | |
| 4,315,553 | A | 2/1982 | Stallings | |
| 4,393,940 | A | 7/1983 | Cooper et al. | |
| 4,448,267 | A | 5/1984 | Crawford, III et al. | |
| 4,478,244 | A | 10/1984 | Garrett | |
| 4,566,494 | A | 1/1986 | Roche | |
| 5,159,981 | A | 11/1992 | Le | |
| 5,896,924 | A | 4/1999 | Carmody et al. | |
| 6,119,772 | A * | 9/2000 | Pruet | 166/81.1 |
| 6,230,824 | B1 | 5/2001 | Peterman et al. | |
| 6,253,861 | B1 | 7/2001 | Carmichael et al. | |
| 6,315,051 | B1 | 11/2001 | Ayling | |
| 6,607,042 | B2 | 8/2003 | Hoyer et al. | |
| 6,622,791 | B2 | 9/2003 | Kelley et al. | |
| 6,739,397 | B2 | 5/2004 | Ayling | |
| 7,028,586 | B2 | 4/2006 | Robichaux | |
| 7,108,080 | B2 | 9/2006 | Tessari et al. | |
| 7,140,455 | B2 | 11/2006 | Walter et al. | |
| 7,163,064 | B2 | 1/2007 | Moncus et al. | |
| 7,219,722 | B2 | 5/2007 | Fincher et al. | |
| 7,308,952 | B2 | 12/2007 | Strazhgorodskiy | |
| 2004/0003490 | A1 | 1/2004 | Shahin et al. | |
| 2004/0020654 | A1 | 2/2004 | Milberger et al. | |
| 2004/0154835 | A1 * | 8/2004 | Allen et al. | 175/170 |
| 2006/0254822 | A1 * | 11/2006 | Ayling | 175/57 |
| 2006/0278434 | A1 | 12/2006 | Calderoni et al. | |
| 2009/0205838 | A1 | 8/2009 | Springett | |
| 2009/0242817 | A1 | 10/2009 | Strazhgorodskiy | |
| 2009/0272580 | A1 | 11/2009 | Dolman et al. | |
| 2010/0084142 | A1 | 4/2010 | Calderoni et al. | |
| 2010/0096190 | A1 | 4/2010 | Younger et al. | |
| 2010/0155143 | A1 | 6/2010 | Braddick | |
| 2010/0252272 | A1 | 10/2010 | Haughom | |
| 2010/0300543 | A1 | 12/2010 | Braddick | |

FOREIGN PATENT DOCUMENTS

| | | |
|---|---|---|
| EP | 1 331 356 | 7/2003 |
| GB | 2 220 963 | 1/1990 |
| GB | 2 325 682 | 12/1998 |
| GB | 2325682 A * | 12/1998 |
| GB | 2 426 274 | 9/2008 |
| SU | 979616 | 12/1982 |
| WO | WO 2005/080745 | 9/2005 |
| WO | WO 2005080745 A1 * | 9/2005 |
| WO | WO 2010/112933 | 10/2010 |

OTHER PUBLICATIONS

Torsvoll et al.—"Continuous Circulation During Drilling Utilizing a Drillstring Integrated Valve—The Continuous Circulation Valve", SPE 98947, IADC/SPE Drilling Conference held in Miami, Florida, Feb. 21-23, 2006, 7 pages.

Vail et al.—"New Developments in Air-Gas Drilling and Completions", Part 1—World Oil, Nov. 1963, pp. 70-73, Part 2—World Oil, Dec. 1963, pp. 82-86.

Weatherford—"Wireline Retrievable Dart Type Float Valve", Brochure No. 336.01, 2003, 2 pages.

Australian Examination Report for Patent Application No. 2008282452 dated Feb. 10, 2011.

Inventors' Solutions Drilling—Production—"Continuous Flushing Drilling (CFD)," date unknown, 25 pages.

Managed Pressure Operations—"Non Stop Driller© Continuous Circulating System," date unknown, 2 pages.

A. Zreik et al.—"Improving Surface Hole Foam Drilling Performance in Karstified Limestone in Papua New Guinea," 2010 ADC/SPE Asia Pac Drilling, Nov. 1-3, 2010, Ho Chi Minh City, Vietnam, 2 pages.

* cited by examiner

FIG. 1A
(PRIOR ART)
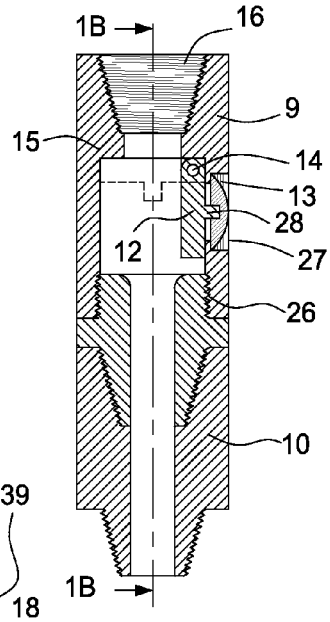
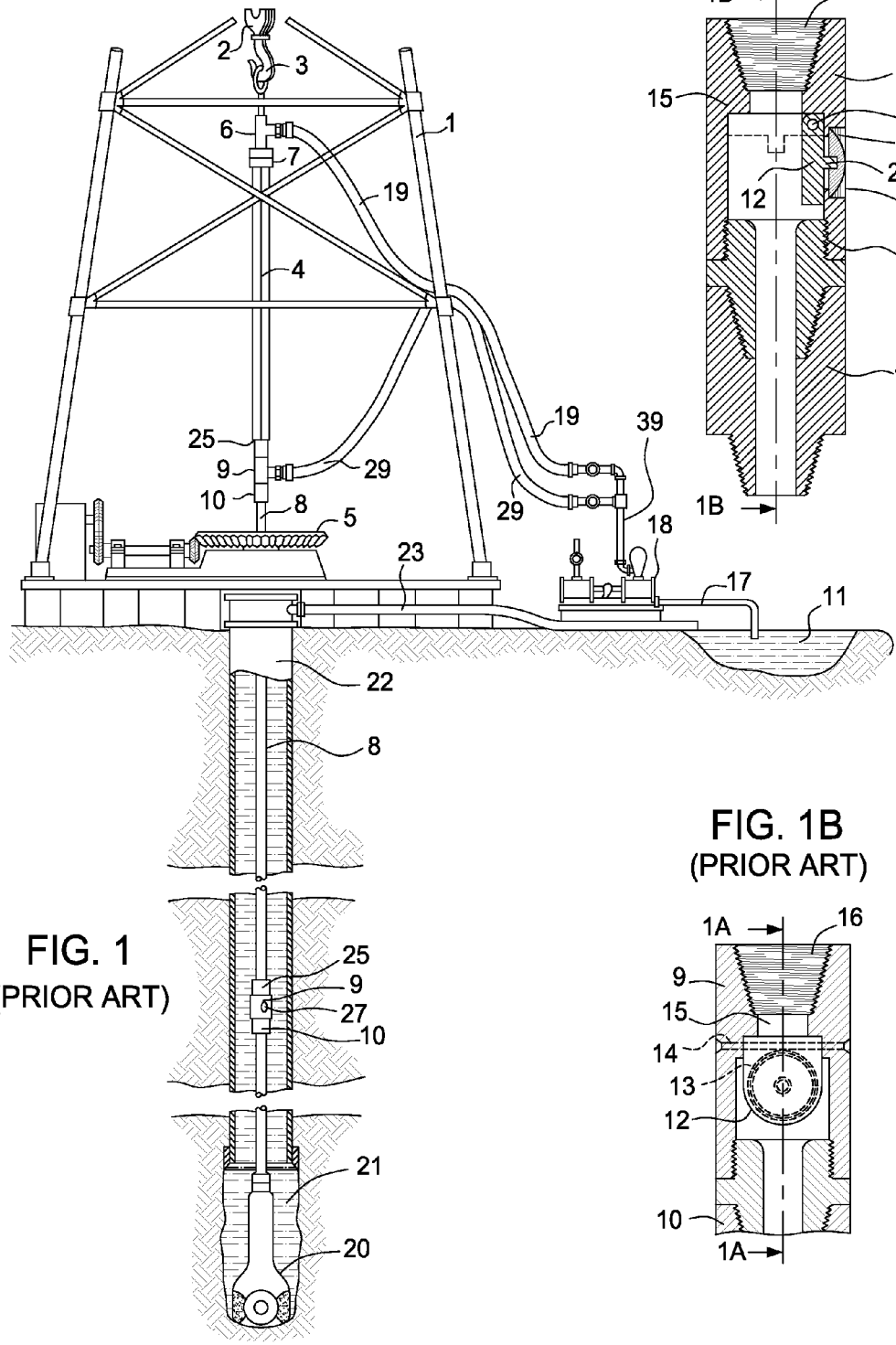
FIG. 1
(PRIOR ART)
FIG. 1B
(PRIOR ART)

| Step | Rig Operation | V1 | V2 | V3 | V4 | V5 | V6 |
|---|---|---|---|---|---|---|---|
| 1 | Normal Drilling | Open | Closed | Open | Open | Closed | Closed |
| 2 | Set Slips | Open | Closed | Open | Open | Closed | Closed |
| 3 | Attach Clamp | Open | Closed | Closed | Open | Closed | Closed |
| 4 | Pressure CFS | Open | Open | Closed | Open | Closed | Closed |
| 5 | Test Clamp | Open | Closed | Closed | Open | Closed | Closed |
| 6 | Bleed CFS | Open | Closed | Open | Open | Closed | Closed |
| 7 | Remove Plug | Open | Closed | Closed | Open | Closed | Closed |
| 8 | Switch Flow to CFS | Open | Open | Closed | Open | Closed | Closed |
| 9 | Isolate Kelly / TD | Closed | Open | Closed | Closed | Closed | Closed |
| 10 | Bleed Kelly / TD | Closed | Open | Closed | Closed | Open | Closed |
| 11 | Add Stand | Closed | Open | Closed | Closed | Open | Closed |
| 12 | Stand Added | Closed | Open | Closed | Closed | Closed | Closed |
| 13 | Switch Flow to Kelly / TD | Open | Open | Closed | Open | Closed | Closed |
| 14 | Isolate CFS | Open | Closed | Closed | Open | Closed | Closed |
| 15 | Install Plug | Open | Closed | Closed | Open | Closed | Closed |
| 16 | Bleed CFS | Open | Closed | Open | Open | Closed | Closed |
| 17 | Test Plug | Open | Closed | Closed | Open | Closed | Closed |
| 18 | Remove Clamp | Open | Closed | Open | Open | Closed | Closed |
| | | | | | | | |
| N/A | Emergency Button | Closed | Closed | Open | Closed | Open | Open |

FIG. 6B

CONTINUOUS FLOW DRILLING SYSTEMS AND METHODS

CROSS-REFERENCE TO RELATED APPLICATIONS

This application claims the benefit of U.S. Prov. Pat. App. No. 60/952,539 , filed on Jul. 27, 2007, and U.S. Prov. Pat. App. No. 60/973,434 , filed on Sep. 18, 2007, which are herein incorporated by reference in their entireties.

BACKGROUND OF THE INVENTION

1. Field of the Invention

The present invention relates to continuous flow drilling systems and methods.

2. Description of the Related Art

In many drilling operations in drilling in the earth to recover hydrocarbons, a drill string made by assembling pieces or joints of drill tubulars or pipe with threaded connections and having a drill bit at the bottom is rotated to move the drill bit. Typically drilling fluid, such as oil or water based mud, is circulated to and through the drill bit to lubricate and cool the bit and to facilitate the removal of cuttings from the wellbore that is being formed. The drilling fluid and cuttings returns to the surface via an annulus formed between the drill string and the wellbore. At the surface, the cuttings are removed from the drilling fluid and the drilling fluid is recycled.

As the drill bit penetrates into the earth and the wellbore is lengthened, more joints of drill pipe are added to the drill string. This involves stopping the drilling while the tubulars are added. The process is reversed when the drill string is removed or tripped, e.g. to replace the drilling bit or to perform other wellbore operations. Interruption of drilling may mean that the circulation of the mud stops and has to be re-started when drilling resumes. This can be time consuming, can cause deleterious effects on the walls of the wellbore being drilled, and can lead to formation damage and problems in maintaining an open wellbore. Also, a particular mud weight may be chosen to provide a static head relating to the ambient pressure at the top of a drill string when it is open while tubulars are being added or removed. The weighting of the mud can be very expensive.

To convey drilled cuttings away from a drill bit and up and out of a wellbore being drilled, the cuttings are maintained in suspension in the drilling fluid. If the flow of fluid with cuttings suspended in it ceases, the cuttings tend to fall within the fluid. This is inhibited by using relatively viscous drilling fluid; but thicker fluids require more power to pump. Further, restarting fluid circulation following a cessation of circulation may result in the overpressuring of a formation in which the wellbore is being formed.

FIG. 1 is a prior art diagrammatic view of a portion of a continuous flow system. FIG. 1A is a sectional elevation of a portion of the union used to connect two sections of drill pipe, showing a short nipple to which is secured a valve assembly. FIG. 1B is a sectional view taken along the line 1B-1B of FIG. 1A.

A derrick 1 supports long sections of drill pipe 8 to be lowered and raised through a tackle having a lower block 2 supporting a swivel hook 3. The upper section of the drill string 8 includes a tube or Kelly 4, square or hexagonal in cross section. The Kelly 4 is adapted to be lowered through a square or hexagonal hole in a rotary table 5 so, when the rotary table is rotated, the Kelly will be rotated. To the upper end of the Kelly 4 is secured a connection 6 by a swivel joint

7. The drill pipe 8 is connected to the Kelly 4 by an assembly which includes a short nipple 10 which is secured to the upper end of the drill pipe 8, a valve assembly 9, and a short nipple 25 which is directly connected to the Kelly 4. A similar short nipple 25 is connected to the lower end of each section of the drill pipe.

Each valve assembly 9 is provided with a valve 12, such as a flapper, and a threaded opening 13. The flapper 12 is hinged to rotate around the pivot 14. The flapper 12 is biased to cover the opening 13 but may pivot to the dotted line position of FIG. 1A to cover opening 15 which communicates with the drill pipe or Kelly through short a nipple 25 into the screw threads 16. The flapper 12 is provided with a screw threaded extension 28 which is adapted to project into the threaded opening 13. A plug member 27 is adapted to be screwed on extension 28 as shown in FIG. 1A, normally holding the valve 12 in the position covering the side opening in the valve assembly. Normally, before drilling commences, lengths of drill pipe are assembled in the vicinity of the drill hole to form "stands" of drill pipe. Each stand may include two or more joints of pipe, depending upon the height of the derrick, length of the Kelly, type of drilling, and the like. The sections of the stand are joined to one another by a threaded connection, which may include nipples 25 and 10, screwed into each other. At the top of each stand, a valve assembly 9 is placed. It will be observed that the valve body acts as a connecting medium or union between the Kelly and the drill string.

Normally, oil well fluid circulation is maintained by pumping drilling fluid from the sump 11 through pipe 17 through which the pump 18 takes suction. The pump 18 discharges through a header 39 into valve controlled flexible conduit 19 which is normally connected to the member 6 at the top of the Kelly, as shown in FIG. 1. The mud passes down through the drill pipe assembly out through the openings in the drill bit 20, into the wellbore 21 where it flows upwardly through the annulus and is taken out of the well casing 22 through a pipe 23 and is discharged into the sump 11. The Kelly 4, during drilling, is being operated by the rotary table 5. When the drilling has progressed to such an extent that is necessary to add a new stand of drill pipe, the tackle is operated to lift the drill string so that the last section of the drill pipe and the union assembly composed of short nipple 25, valve assembly 9, and short nipple 10 are above the rotary table. The drill string is then supported by engaging a spider (not shown).

The plug 27 is unscrewed from the valve body and a hose 29, which is controlled by a suitable valve, is screwed into the screw threaded opening 13. While this operation takes place, the circulation is being maintained through hose 19. When connection is made, the valve controlling hose 29 is opened and momentarily mud is being supplied through both hoses 19 and 29. The valve controlling hose 19 is then closed and circulation takes place as before through hose 29. The Kelly is then disconnected and a new stand is joined to the top of the valve body, connected by screw threads 16. After the additional stand has been connected, the valve controlling hose 19 is again opened and momentarily mud is being circulated through both hoses 19 and 29. Then the valve controlling hose 29 is closed, which permits the valve 12 to again cover opening 13. The hose 29 is then disconnected and the plug 27 is replaced.

SUMMARY OF THE INVENTION

In one embodiment, a method for drilling a wellbore includes injecting drilling fluid into a top of a tubular string disposed in the wellbore at a first flow rate. The tubular string includes: a drill bit disposed on a bottom thereof, tubular joints connected together, a longitudinal bore therethrough, and a port through a wall thereof. The drilling fluid exits the drill bit and carries cuttings from the drill bit. The cuttings and drilling fluid (returns) flow to the surface via an annulus defined between the tubular string and the wellbore. The method further includes rotating the drill bit while injecting the drilling fluid; remotely removing a plug from the port, thereby opening the port; and injecting drilling fluid into the port at a second flow rate while adding a tubular joint or stand of joints to the tubular string. The injection of drilling fluid into the tubular string is continuously maintained between drilling and adding the joint or stand to the drill string. The method further includes remotely installing a plug into the port, thereby closing the port. The first and second flow rates may be substantially equal or different.

In another embodiment, a continuous flow system for use with a drill string includes a tubular housing having a longitudinal bore therethrough and a port formed through a wall thereof; a float valve disposed in the bore; a plug operable to be disposed in the port, the plug having a latch for coupling the plug to the housing; and a clamp operable to engage an outer surface of the housing and seal the port, the clamp comprising a hydraulic actuator operable to remove the plug from the port and install the plug into the port.

In another embodiment, a method for drilling a wellbore includes injecting drilling fluid into a top of a tubular string disposed in the wellbore at a first flow rate. The tubular string includes: a drill bit disposed on a bottom thereof, tubular joints connected together, a longitudinal bore therethrough, and a port through a wall thereof. The drilling fluid exits the drill bit and carries cuttings from the drill bit. The cuttings and drilling fluid (returns) flow to the surface via an annulus defined between the tubular string and the wellbore. The method further includes engaging the tubular string with a rotating control device (RCD). A variable choke valve is disposed in an outlet line in fluid communication with the RCD. The method further includes rotating the drill bit while injecting the drilling fluid; and controlling pressure of the returns using the variable choke valve; and injecting drilling fluid into the port at a second flow rate while adding a tubular joint or stand of joints to the tubular string. The injection of drilling fluid into the tubular string is continuously maintained between drilling and adding the joint or stand to the drill string. The first and second flow rates may be substantially equal or different.

In another embodiment, a continuous flow sub for use with a drill string includes: a tubular housing having a longitudinal bore therethrough and a port formed through a wall thereof; a float valve disposed in the bore; a plug and/or check valve disposed in the port; and a centralizer or stabilizer coupled to the housing and extending outward from an outer surface of the housing.

In another embodiment, a method for drilling a wellbore includes rotating a drill bit connected to a bottom of a first tubular string. The first tubular string includes: a drill bit disposed on a bottom thereof, tubular joints connected together, a longitudinal bore therethrough, and a port through a wall thereof. The method further includes injecting drilling fluid into the wellbore while rotating the drill bit. The drilling fluid exits the drill bit and carries cuttings from the drill bit. The cuttings and drilling fluid (returns) flow to the surface. The method further includes injecting drilling fluid into a first annulus formed between the first tubular string and a second tubular string while adding a tubular joint or stand of joints to the tubular string. The drilling fluid is diverted into the port and through the drill string by a seal disposed in the first annulus. The returns are diverted into a second annulus or third tubular string by the seal.

In another embodiment, a continuous flow sub for use with a drill string includes: a tubular housing having a longitudinal bore therethrough and a port formed through a wall thereof; a float valve disposed in the bore; a check valve disposed in the port; and an annular seal disposed around the housing.

In another embodiment, a method for drilling a wellbore includes injecting drilling fluid into a top of a tubular string disposed in the wellbore at a first flow rate. The tubular string includes: a drill bit disposed on a bottom thereof, tubular joints connected together, a longitudinal bore therethrough, a port through a wall thereof, and a sleeve operable between an open position where the port is exposed to the bore and a closed position where a wall of the sleeve is disposed between the port and the bore. The drilling fluid exits the drill bit and carries cuttings from the drill bit. The cuttings and drilling fluid (returns) flow to the surface via an annulus defined between the tubular string and the wellbore. The method further includes: rotating the drill bit while injecting the drilling fluid; moving the sleeve to the open position; and injecting drilling fluid into the port at a second flow rate while adding a tubular joint or stand of joints to the tubular string. The injection of drilling fluid into the tubular string is continuously maintained between drilling and adding the joint or stand to the drill string. The first and second flow rates may be substantially equal or different.

In another embodiment, a continuous flow sub for use with a drill string includes: a tubular housing having a longitudinal bore therethrough and a port formed through a wall thereof; a float valve disposed in the bore; and a sleeve operable between an open position where the port is exposed to the bore and a closed position where a wall of the sleeve is disposed between the port and the bore.

In another embodiment, a clamp for use with a continuous flow system having a housing and a plug disposed in a port of the housing includes: a body operable to engage an outer surface of the housing and seal the outer surface around the port; a first piston disposed in the body and having a latch operable to engage the plug, thereby coupling the first piston and the latch; a second disposed in the body piston operable to retain the plug so that the first piston latch may disengage from the plug; and an inlet for injecting fluid into the port.

In another embodiment, a float valve for use in a drill string includes a tubular housing having a longitudinal bore therethrough; a seal disposed around the housing; a valve member disposed in the housing and operable between a closed position and an open position. The valve member seals a first portion of the bore from a second portion of the bore in the closed position. The valve member allows fluid communication between the bores in the open position. The float valve further includes a spring biasing the valve member toward the closed position; and a valve actuator operable to retain the valve in the open position. The valve actuator includes a latch: operable between a retracted position and an expanded position; operable to engage a profile formed in the housing in the expanded position; and restricting the bore to a reduced internal diameter in the retracted position. The bore is substantially unobstructed in the expanded position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 1 is a diagrammatic view of a prior art continuous flow system. FIG. 1A is a sectional elevation of a portion of the union used to connect two sections of drill pipe, showing a short nipple to which is secured a valve assembly. FIG. 1B is a sectional view taken along the line 1B-1B of FIG. 1A.

FIG. 6B is a table illustrating valve positions for operational acts of adding/removing joints/stands to/from the drill string while circulating through the drill string.

FIG. 9A is a top view of the plug.

DETAILED DESCRIPTION

Figure 2:
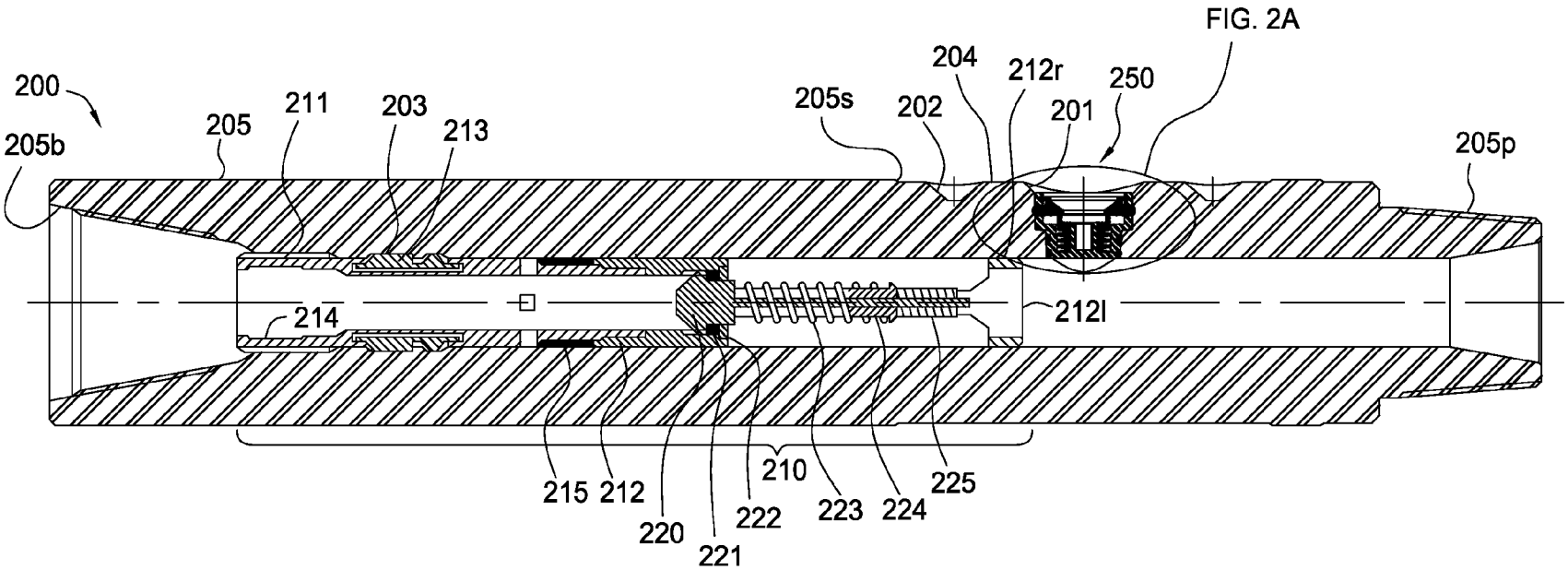
FIG. 2 is a cross-sectional view of a continuous flow sub (CFS), according to one embodiment of the present invention.

FIG. 2 is a cross-sectional view of a continuous flow sub (CFS) 200, according to one embodiment of the present invention. The CFS 200 may include a tubular housing 205, a float valve 210, and the plug 250. The tubular housing 205 may have a longitudinal bore therethrough, and a radial port 201 formed through a wall thereof in fluid communication with the bore. The housing 205 may also have a threaded coupling at each longitudinal end, such as box 205*b* formed in a first longitudinal end and a threaded pin 205*p* formed on a second longitudinal end, so that the housing may be assembled as part of the drill string 8. An outer surface of the housing 205 may taper at 205*s* from a greater diameter to a lesser diameter. The outer surface may then taper again and return to the greater diameter, thereby forming a recessed portion between the two tapers. The recessed portion may include one or more locator openings 202 formed therein, a seal face 204, and the port 201. A latch profile 203 may be formed in an inner surface of the housing 205 along the bore. Except for seals, the CFS 200 may be made from a metal or alloy, such as steel or stainless steel. Seals may be made from a polymer, such as an elastomer.

The float valve 210 may include a latch mandrel 211, one or more drag blocks 213, a valve mandrel 212, and a poppet 220. The mandrels 211, 212 may be tubular members each having a wall and a longitudinal bore. The mandrels 211, 212 may be longitudinally coupled, such as by a threaded connection. The drag blocks 213 may each be received in recesses formed in the latch mandrel. Each drag block 213 is radially movable between an extended position and a retracted position. Each drag block 213 may be biased toward an extended position by one or more springs (not shown), such as coil springs or leaf springs. A profile may be formed along an outer surface of each drag block 213. The drag block profiles may each correspond to the profile 203 formed in the tubular 205 so the drag blocks 213 engages the profile 203 when the drag blocks are longitudinally aligned with the profile 203. Engagement of the drag blocks 213 with the profile may longitudinally couple the latch mandrel 211 to the housing 205. The latch mandrel 211 may have a profile 214 formed on an inner surface for receiving a latch from a wireline-deployed retrieval tool. The retrieval tool may disengage the drag blocks 213 from the profile 203, thereby allowing retrieval of the float valve 210 to the surface without tripping the drill string if the float valve fails or if wireline operations need to be conducted through the drill string, such as in well control situation (i.e., stuck drill string). The valve mandrel 212 may have one or more windows formed therethrough and one or more legs 212*l* defining the windows. Ends of the legs may be connected by a rim 212*r*.

One or more seals 215, such as a seal stack, may be disposed along an outer surface of the latch mandrel 211. The seal stack may include one or more chevron seals facing the pin 205*p* and one or more chevron seals facing the box 205*b*. End adapters may back-up the seals and a center adapter may separate the seals. The seals may engage the housing inner surface and the latch mandrel outer surface, thereby preventing fluid from bypassing the poppet 220.

The poppet 220 may be longitudinally movable between an open position and a closed position. The poppet may include a tapered or mushroom shaped head and a stem. A seal 221 may be disposed along an outer surface of the head. A retainer ring 222 may be longitudinally coupled to the head and abut the seal. The seal may engage an outer surface of the head and an inner surface of the valve mandrel 212 in the closed position. The head may be biased toward the closed position by a spring 223, such as a coil spring. The poppet stem may extend through bores formed in a spring retainer 224 and a guide 225. The poppet stem may be slidable relative to the spring retainer and the guide but laterally restrained thereby. The spring retainer 224 may be longitudinally coupled to the guide. The guide may include one or more spokes (not shown) which radially extend therefrom and engage a slot (not shown) formed in an inner surface of a respective leg 212*l*. The spring 223 may bias the spokes against ends of the slots, thereby longitudinally and rotationally coupling the guide and the valve mandrel. In operation, when fluid pressure acting on the poppet head from the box end of the CFS exceeds the combined pressure exerted by fluid from the pin end of the CFS and the spring 223, the poppet moves to the open position allowing fluid flow through the mandrels 211, 212. When fluid pressure exerted from the box end is reduced below the combined pressure, the poppet moves to the closed position as shown.

Alternatively, the poppet valve 212, 220-225 may be replaced by a flapper or ball valve. Alternatively, the float valve 210 may be non-retrievable, such as by replacing the drag blocks 213 and profile 203 with a fastener, such as a threaded connection or snap ring and shoulder. Alternatively, as is discussed below with reference to FIG. 7, the float valve 210 may be replaced by the float valve 710.

A length of the housing 205 may be equal to or less than the length of a standard joint of drill pipe. The housing may include one or more sub-housings threaded together, such as a first sub-housing including the float valve 210 and a second sub-housing including the port 201. The housing 205 may be provided with one or more pup joints in order to provide for a total assembly length equivalent to that of a standard joint of drill pipe. The pup joints may include one or more stabilizers or centralizers or the stabilizers or centralizers may be mounted on the housing.

Additionally, the housing 205 may further include one or more external stabilizers or centralizers. Such stabilizers or centralizers may be mounted directly on an outer surface of the housing &/or proximate the housing above and/or below it (as separate housings). The stabilizers or centralizers may be of rigid construction or of yielding, flexible or sprung construction. The stabilizers or centralizers may be constructed from any suitable material or combination of materials, such as metal or alloy, or a polymer, such as an elastomer, such as rubber. The stabilizers or centralizers may be molded or mounted in such a way that rotation of the sub about its longitudinal axis also rotates the stabilizers or centralizers. Alternatively, the stabilizers or centralizers may be mounted such that at least a portion of the stabilizers or centralizers may be able to rotate independently of the sub.

Figure 2A:
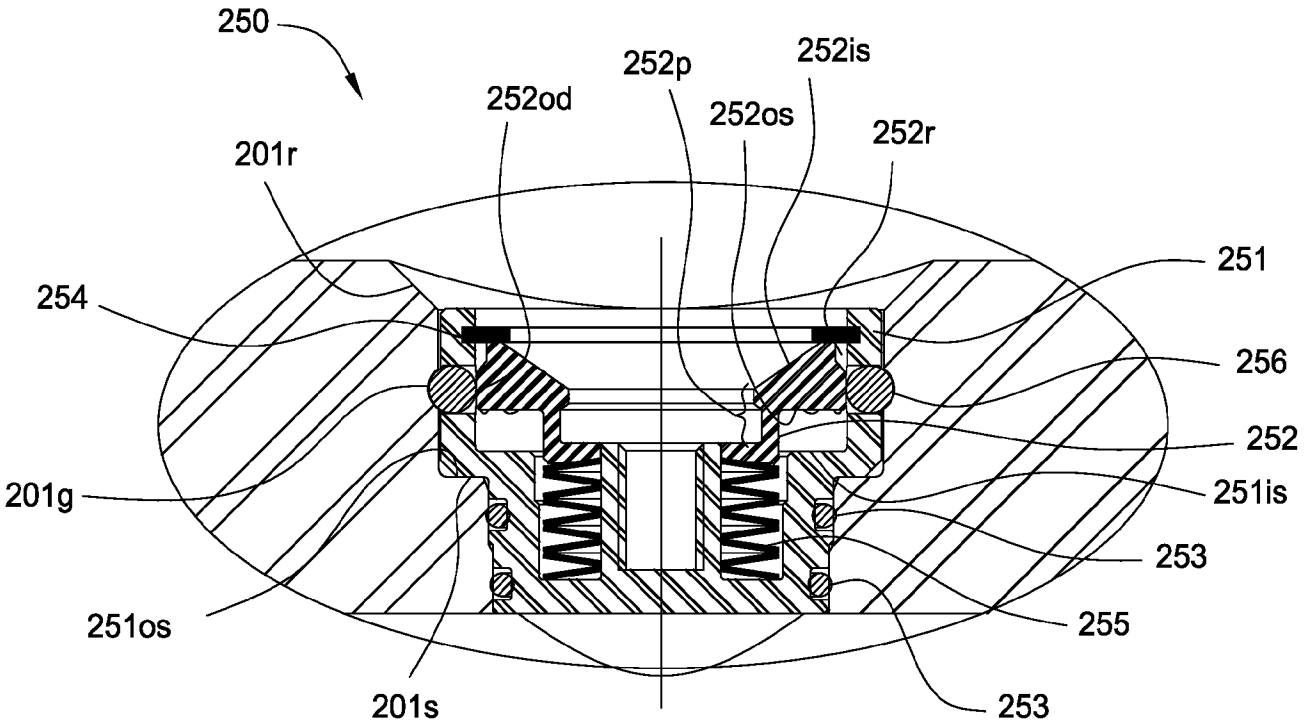
FIG. 2A is an enlargement of a plug of the CFS.

FIG. 2A is an enlargement of plug 250 of the CFS 200. The plug 250 may have a curvature corresponding to a curvature of the CFS housing 205. The plug 250 may include a body 251, a latch 252, 256, one or more seals, such as o-rings 253, a retainer, such as a snap ring 254, and a spring, such as a disc 255 or coil spring. The latch may include a locking sleeve 252 and one or more balls 256. The body 251 may be an annular member having an outer wall, an inner wall, an end wall, and an opening defined by the walls. The outer wall may taper from an enlarged diameter to a reduced diameter. The outer wall may form an outer shoulder 251*os* and an inner shoulder 251*is* at the taper. The outer wall may have a radial port therethrough for each ball 256. The outer shoulder 251*os* may seat on a corresponding shoulder 201*s* formed in the housing port 201. The balls 256 may seat in a corresponding groove 201*g* formed in the wall defining the housing port 201, thereby longitudinally coupling the body to the housing 205. The housing port 201 may further include a taper 201*r*. The taper 201*r* may facilitate passage of the housing 205 through a rotating control device (RCD, discussed below) so that the port 201 does not damage a seal of the RCD. Alternatively, the taper 201*r* may receive the clamps seals 333 instead of the seal face 204. The recess may be shielded from contacting the wellbore by an outer surface of the housing, thereby reducing risk of becoming damaged and compromising sealing integrity. One or more seals, such as o-rings 253, may seal an interface between the plug body 251 and the housing 205.

The locking sleeve 252 may be disposed in the body 251 between the inner and outer walls and may be longitudinally movable relative thereto. The locking sleeve may be retained in the body by a fastener, such as snap ring 254. The disc spring 255 may be disposed between the locking sleeve and the body and may bias the locking sleeve toward the snap ring. An outer surface of the locking sleeve may taper to form a recess 252*r*, an enlarged outer diameter 252*od*, and a shoulder 252*os*. One or more protrusions may be formed on the outer shoulder 252*os* to prevent a vacuum from forming when the outer shoulder seats on the body inner shoulder 251*is*. An inner surface of the locking sleeve may taper to form an inclined shoulder 252*is* and a latch profile 252*p*.

Figure 3:
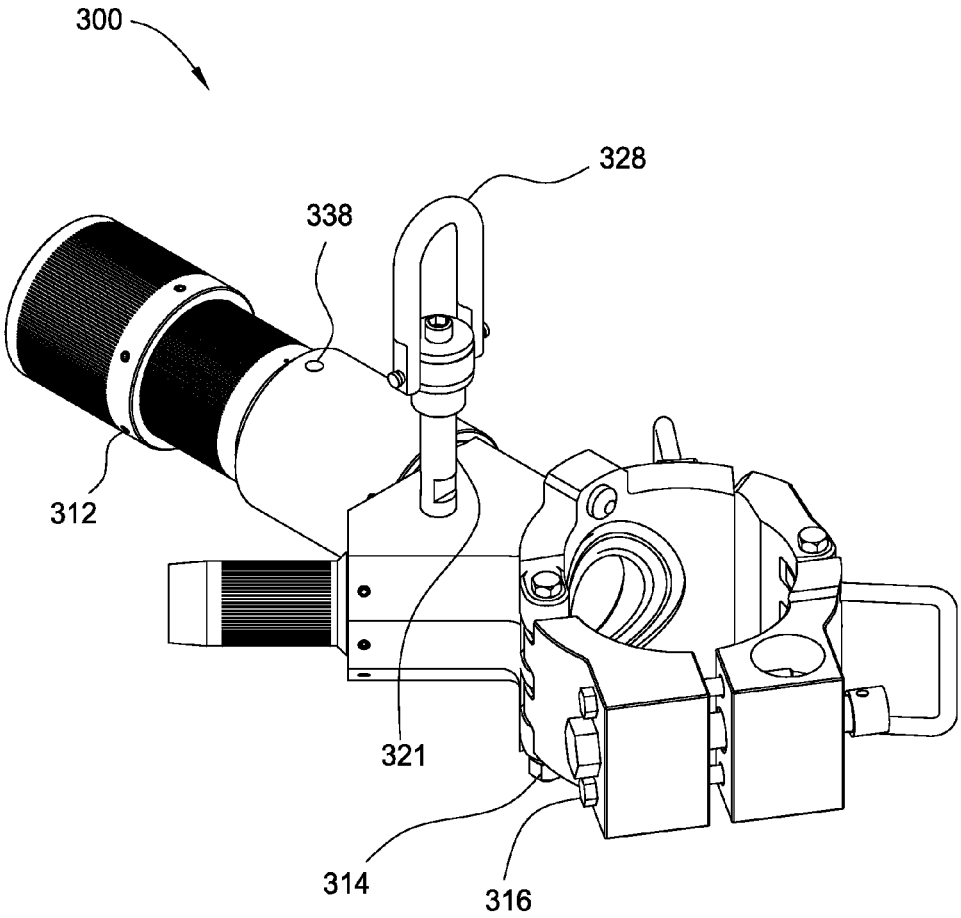
FIG. 3 is an isometric view of a clamp for use with the CFS, according to another embodiment of the present invention.
Figure 3A:
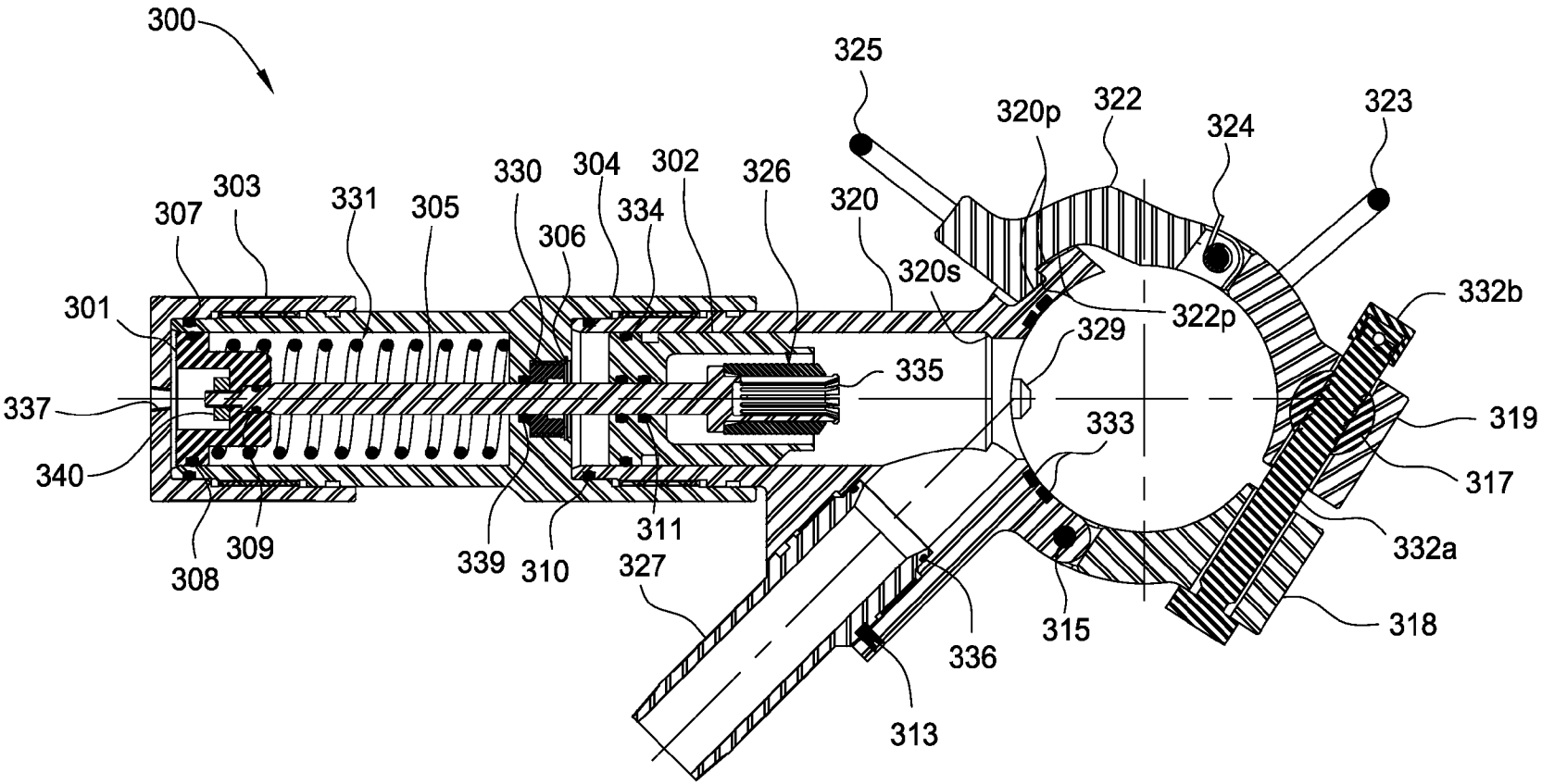
FIG. 3A is a cross-sectional view of the clamp.

FIG. 3 is an isometric view of a clamp 300 for use with the CFS 200, according to another embodiment of the present invention. FIG. 3A is a cross-sectional view of the clamp 300. The clamp 300 may include a hydraulic actuator, such as a retrieval piston 301 and a retaining piston 302; an end cap 303, a chamber housing 304, a piston rod 305, a fastener, such as a snap ring 306; one or more seals, such as o-rings 306-311, 334, 336, 339; one or more fasteners, such as set screws 312, 313; one or more fasteners, such as nuts 314 and cap screws 315; one or more fasteners, such as cap screws 316; one or more fasteners, such as a tubular nut 317; one or more clamp bands 318,319; a clamp body 320; a clamp handle 321; a clamp latch 322; one or more handles, such as a clamp latching handle 323 and a clamp unlatching handle 325; one or more springs, such as torsion spring 324 and coil spring 331; a rod sleeve 326; a flow nipple 327; a hoist ring 328; a locator, such as dowel 329; a plug 330; a tension adjuster, such as bolt 332*a* and stopper 332*b*; one or more seals, such as rings 333; a latch, such as collet 335; one or more hydraulic ports 337, 338, and a fastener, such as nut 340. Alternatively, the actuator may be pneumatic or electric.

The chamber housing 304 may be a tubular member having a longitudinal bore and a wall defining a first chamber, a partition, and a second chamber. The cap 303 may be longitudinally coupled to a first end of the chamber housing 304 by a threaded connection and enclose the first chamber. The o-ring 307 may seal an interface between the chamber housing and the cap. The hydraulic port 337 may be formed through an end of the cap and be threaded for receiving a hydraulic conduit (see FIG. 6A). The hydraulic port 337 may provide fluid communication between the hydraulic conduit and a first end of the retrieval piston 301.

The retrieval piston 301 may be an annular member and disposed in the first chamber. The o-ring 307 may seal an interface between the retrieval piston and the chamber housing 304. The retrieval piston may be longitudinally movable relative to the chamber housing. A first end of the piston rod 305 may be threaded, tapered, and disposed through a tapered opening formed in the retrieval piston. The nut 340 may be disposed in a recess formed in the retrieval piston and fastened to the first end of the piston rod, thereby longitudinally coupling the piston rod and the retrieval piston. The o-ring 309 may seal the interface between the retrieval piston and the piston rod. The piston rod may extend through the partition. The o-ring 339 may seal the interface between the piston rod and the partition. An outer surface of the retrieval piston may taper from a greater diameter to a lesser diameter and form a shoulder between the diameters. The shoulder may receive a first end of the coil spring 331. A second end of the coil spring may be disposed against a first end of the partition, thereby biasing the retrieval piston toward the cap and away from the partition. A recess may be formed in the partition. The recess may be threaded and may receive the plug 330. The plug may have a longitudinal bore therethrough which may receive the piston rod. The snap ring 306 may retain the plug in the recess.

The chamber housing 304 may be longitudinally coupled to the clamp body 320 by a threaded connection. An inner surface of the second chamber wall may receive a first end of the clamp body 320 and an interface therebetween may be sealed by the o-ring 310. A hydraulic port 338 may be formed through the second chamber wall and may be threaded for receiving a hydraulic conduit (see FIG. 6A). The hydraulic port 338 may provide fluid communication between the hydraulic conduit and a first end of the retaining piston 302. A second end of the partition may enclose the second chamber. The second chamber may be extended by a first portion of the body 320. An inner surface of the first portion of the body may taper from a greater diameter to a lesser diameter, thereby forming shoulder 320*s*. The retaining piston 302 may be disposed in the clamp body and longitudinally movable relative to the chamber housing and the clamp body. An interface between the retaining piston and the clamp body may be sealed by the o-ring 334. The retaining piston may be an annular member having a longitudinal bore therethrough and a recess formed therein. An outer surface of the retaining piston 302 may taper from a greater diameter to a lesser diameter proximate to a second end thereof, thereby forming a lip.

The piston rod 305 may extend through a portion of the retaining piston and an interface therebetween may be sealed by the o-rings 311. The piston rod may taper from a lesser diameter to a greater diameter proximate to the second end and may form a shoulder between the diameters. The second end of the partition, the piston rod shoulder, and the body shoulder 320*s* may serve as longitudinal stops for the retaining piston. The piston rod may taper again proximate the second end from the greater diameter to a lesser diameter and may form a shoulder between the diameters. The second end of the piston rod may form a collet 335 having one or more fingers. The fingers may have a latch profile corresponding to the profile 252*p* formed on an inner surface of the locking sleeve 252. The sleeve 326 may be disposed between the shoulder and an end of the collet fingers and have a tapered end corresponding to the inclined inner shoulder 252 is formed on an inner surface of the locking sleeve 252.

The clamp body 320 may include a second portion having a longitudinal bore in fluid communication with the second chamber. An inner surface may be threaded for receiving a threaded outer surface of the flow nipple 327. One or more set screws 313 may be disposed in respective threaded openings formed through the second portion and engage an outer surface of the flow nipple. The interface between the flow nipple and the second portion may be sealed by the o-ring 336. The flow nipple may receive the outlet 29 from the mud pump 18 (see FIG. 6A). The clamp handle 321 may be connected to the clamp body. The hoist ring 328 may be pivoted to the clamp handle and receive a hook from a support, such as beam assembly 400 or telescoping arm 450.

The clamp body 320 may include a third portion configured to engage an outer surface of the CFS housing 205 so that the second chamber is in fluid communication with the port 201. The third portion may include the dowels 329 configured to engage the recesses 202, thereby aligning the second chamber with the port 201 and longitudinally coupling the clamp to the housing 205. The interface between the clamp body 320 and the port 201 may be sealed by the seals 333 engaging the seal face 204 of the housing 205. The clamp body third portion may include a hinged portion for receiving a corresponding hinged portion of the clamp band 318. The cap screw 315 and lock nut 314 may retain the hinged portions together. The bands 318, 319 and latch 322 may each be annular segments for engaging an outer surface of the housing 205. The clamp band 318 may include respective bores therethrough for receiving the cap screws 316. The bores may be slightly oversized to prevent binding.

The band 319 may have respective threaded openings for receiving the cap screws 316. Lengths of the cap screws may allow a clearance between the bands 318, 319 so that circumferential tension in the clamp may be adjusted by the tension bolt 332*a*. The bands 318, 319 may each include a corresponding bore therethrough for receiving the tension bolt 332*a* and the bores may each be oversized. The band 319 may also include an opening formed therein for receiving the tubular nut 319. The tubular nut may rotate relative to the opening and may have a threaded bore for receiving the tension bolt 332*a*. Rotation of the tubular nut may prevent binding of the tension bolt 332*a* and may allow replacement due to wear. A stopper 332*b* may be connected to the bolt 332*a* with a threaded connection. The latching handle 323 may be connected to the band 319. The band 319 may include a hinged portion for receiving a corresponding hinged portion of the latch 322. The cap screw 315 and lock nut 314 may retain the hinged portions together. The torsion spring 324 may bias the latch toward the clamp body 320. The unlatching handle 325 may be connected to the latch 322. The latch may have a profile 322*p* configured to mate with a corresponding profile 320*p* formed in the third portion of the clamp body 320, thereby circumferentially coupling the latch and the clamp body.

The clamp 300 may be manually operable between an open position and a closed position (shown). In the closed position, the clamp may be manually operable from a disengaged position to an engaged position by tightening the tension bolt 332*a* until an inner surface of the bands 318, 319, the body 320, and the latch 322 press against an outer surface of the CFS housing 205, thereby engaging the seals 333 with the seal face 204. In the engaged position, circumferential tension may frictionally lock latch profile 322*p* against the clamp body profile 320*p* in addition to biasing force of the torsion spring 324. To open the clamp 300, the tension bolt 332*a* is loosened and the latch profile is pulled free from the profile 320*p* using the handle 325 while overcoming the torsion spring 324. Either of the handles 323, 325 may be used to rotate the bands 318, 319 and latch 322 about the hinge between the band 318 and the clamp body and away from the CFS 200. To close the clamp 300, one or more of the handles 323, 325 are operated to surround the CFS 200 and engage the profile 322*p* with the profile 320*p*.

Alternatively, the bands 318, 319 and latch 322 may be replaced by automated (i.e., hydraulic) jaws. Such jaws are discussed and illustrated in U.S. Pat. App. Pub. No. 2004/0003490 , which is herein incorporated by reference in its entirety.

Figure 4A:
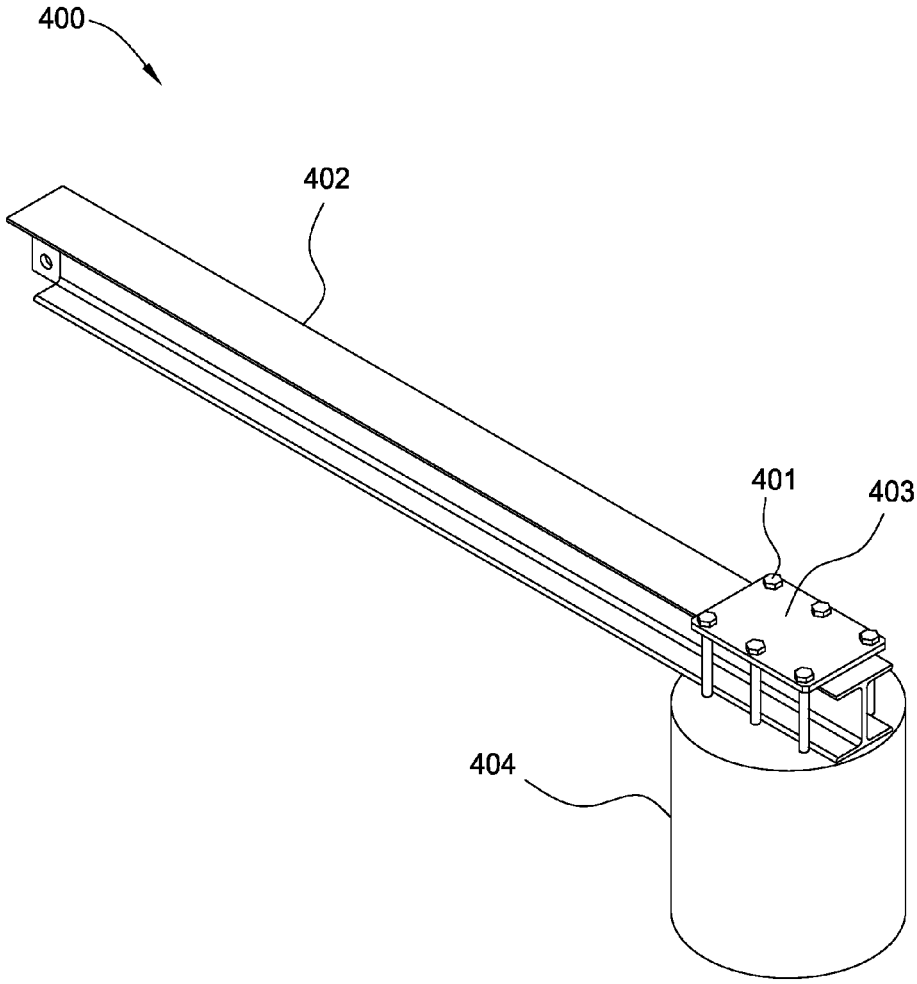
FIG. 4A is an isometric view of a beam assembly for transporting and supporting the clamp, according to another embodiment of the present invention.

FIG. 4A is an isometric view of a beam assembly 400 for transporting and supporting the clamp 300, according to another embodiment of the present invention. The beam assembly 400 may include a one or more fasteners, such as bolts 401, a beam, such as an I-beam 402, a fastener, such as a plate 403, and a counterweight 404. The counterweight 404 may be clamped to a first end of the beam using the plate 403 and the bolts 401. A hole may be formed in the second end of the beam for connecting a cable (not shown) which may include a hook for engaging the hoist ring 328. One or more holes (not shown) may be formed through a top of the beam 402 at the center for connecting a sling which may be supported from the derrick 1 by a cable. Using the beam assembly, the clamp 300 may be suspended from the derrick 1 and swung into place adjacent the CFS 200 when needed for adding or removing joints or stands to/from the drill string 8 and swung into a storage position during drilling.

Figure 4B:
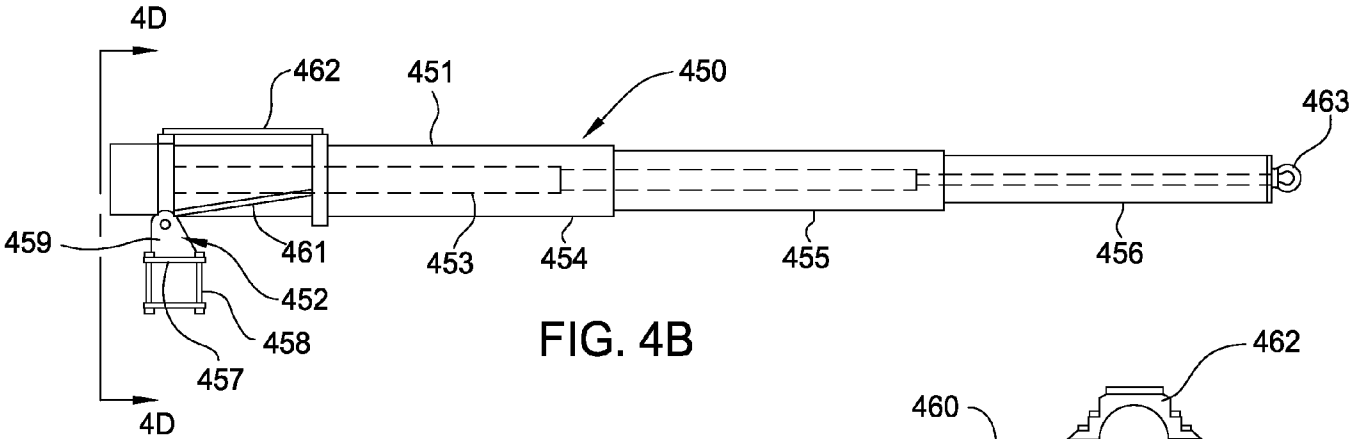
FIG. 4B is a side elevation of a telescoping arm for supporting the clamp, according to another embodiment of the present invention.
Figure 4D:
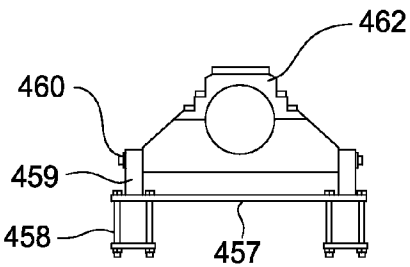
FIG. 4D is an end view taken on line 4D-4D of FIG. 4B.
Figure 4C:
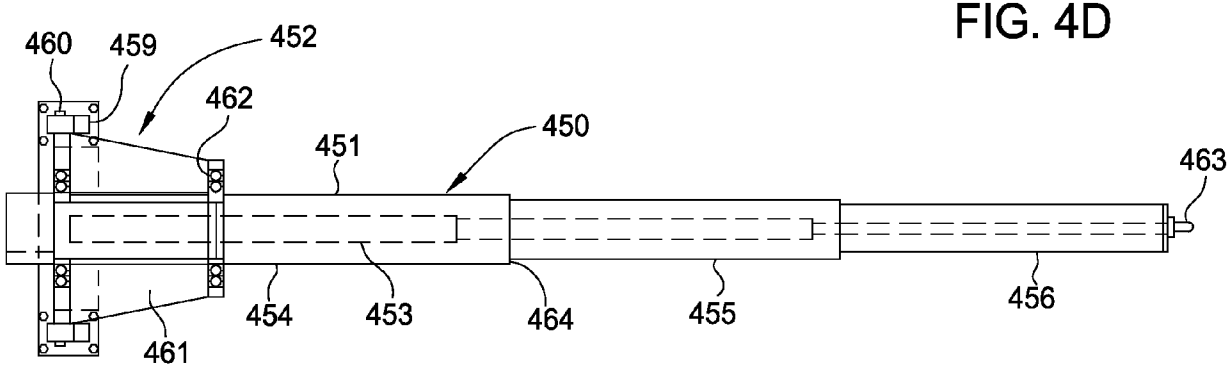
FIG. 4C is a top plan view of the telescoping arm.
Figure 5A:
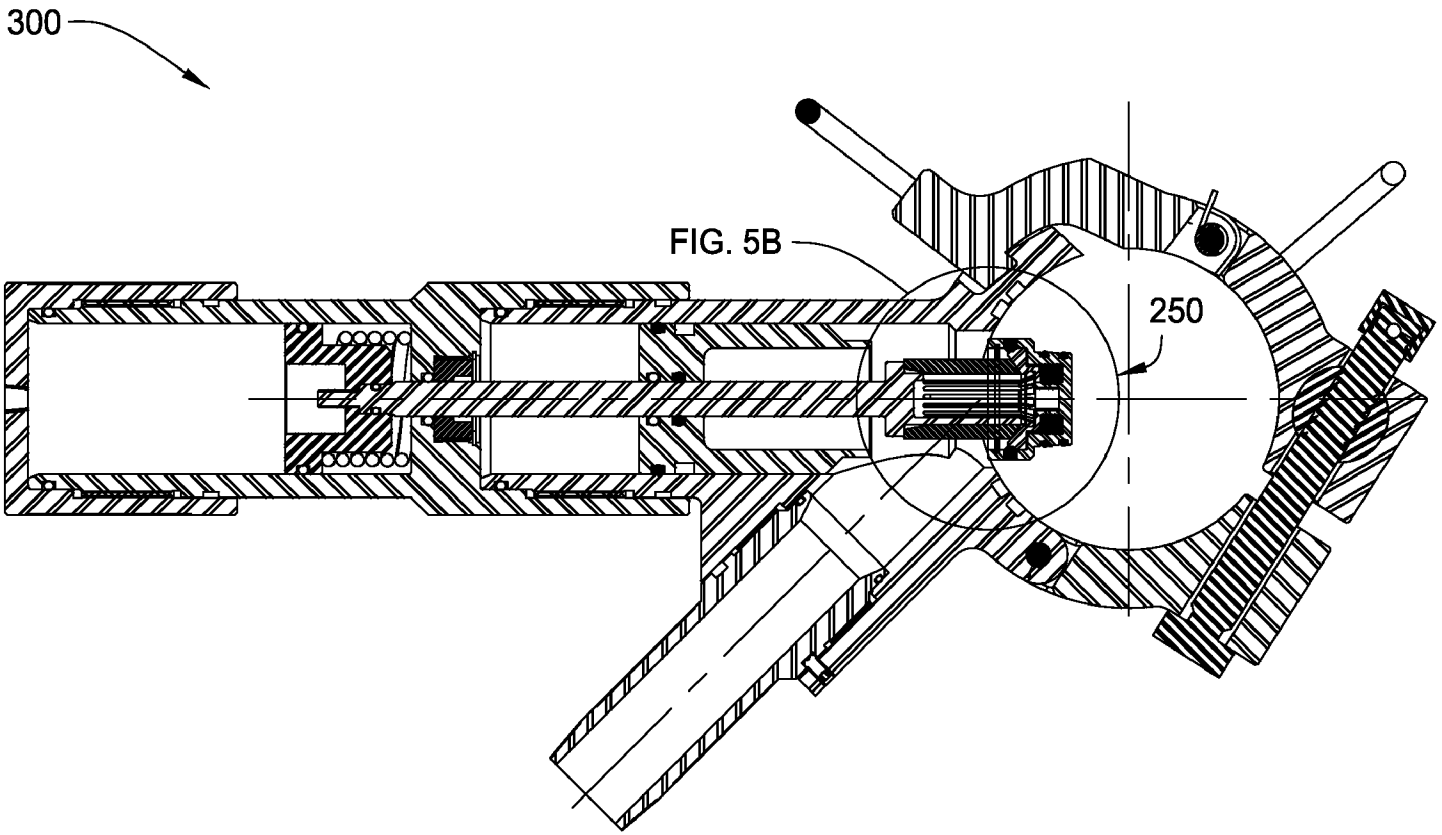
FIGS. 5A-5E are cross-sectional views of the clamp and CFS plug in various operational positions.
Figure 5B:
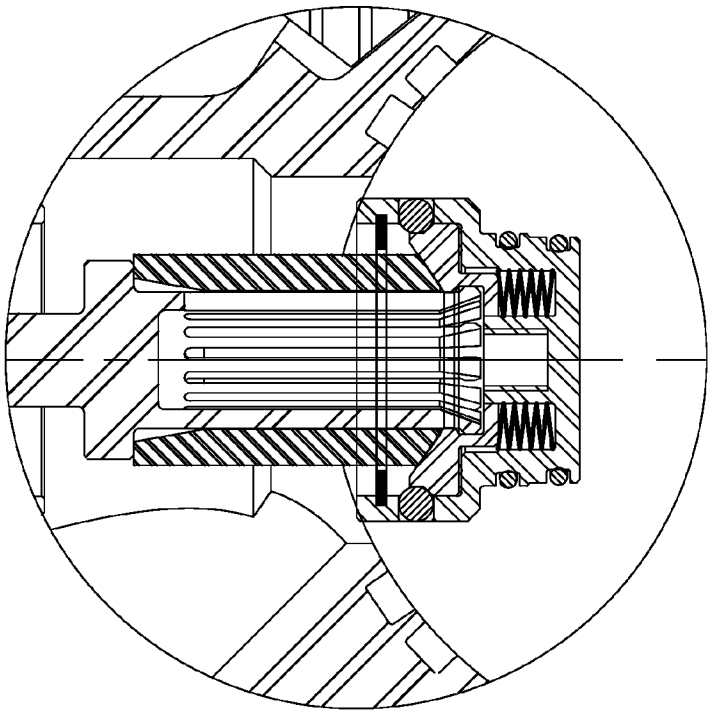
Figure 5C:
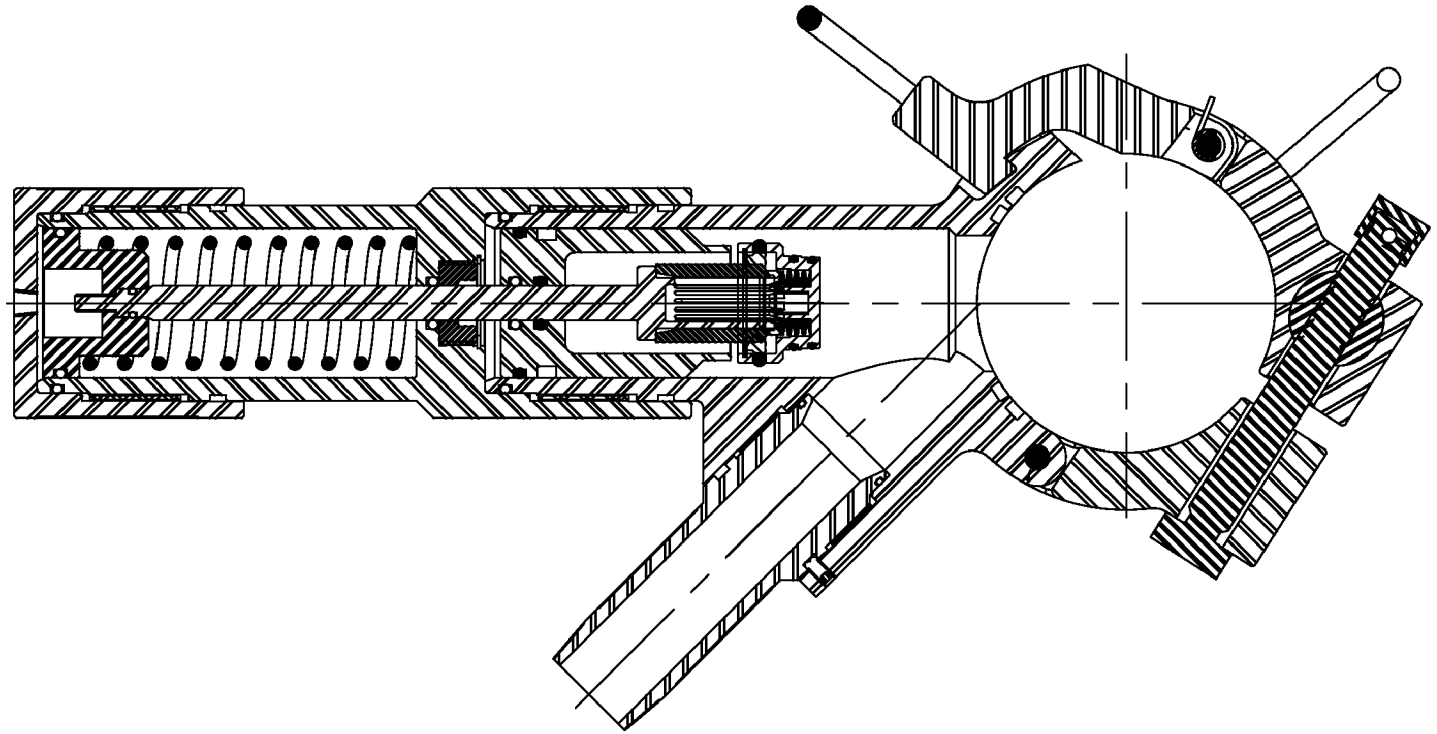
Figure 5D:
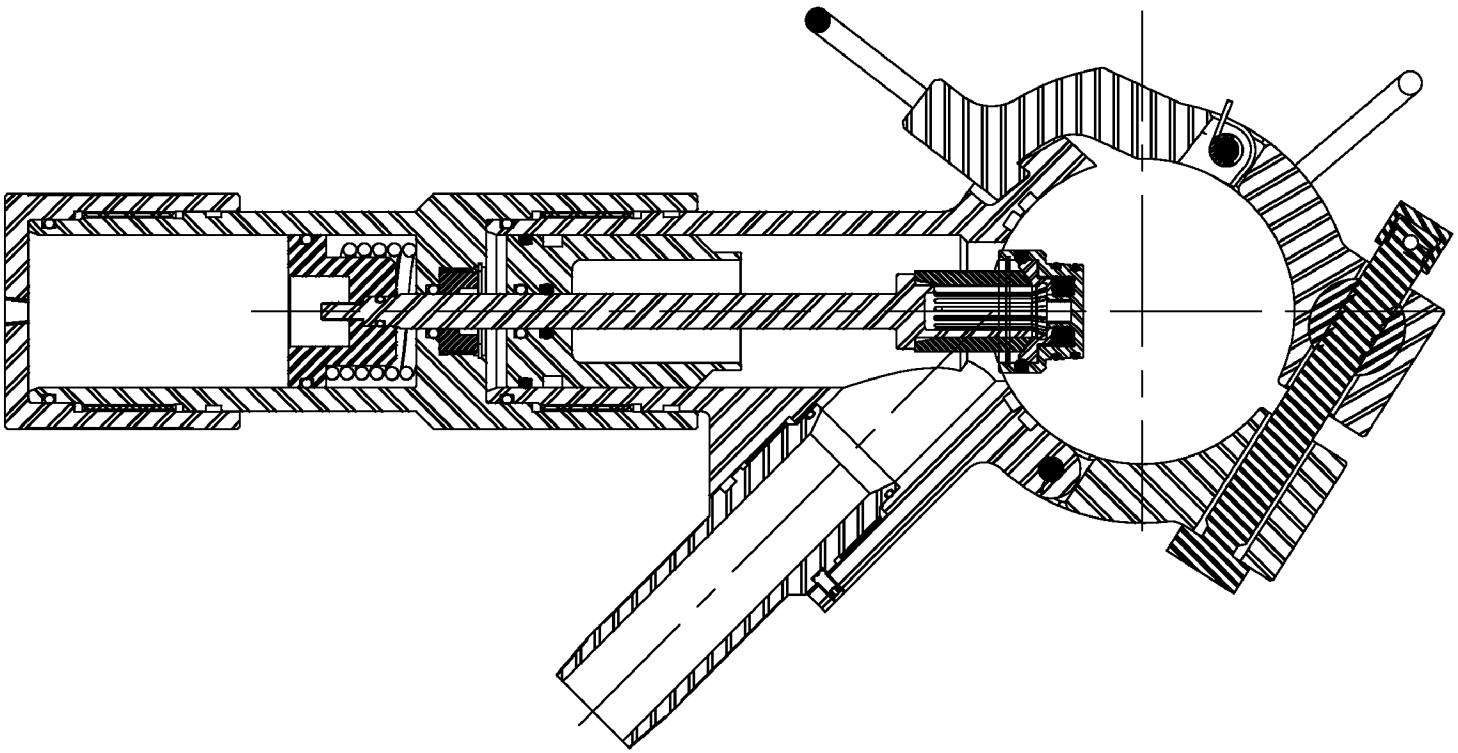
Figure 5E:
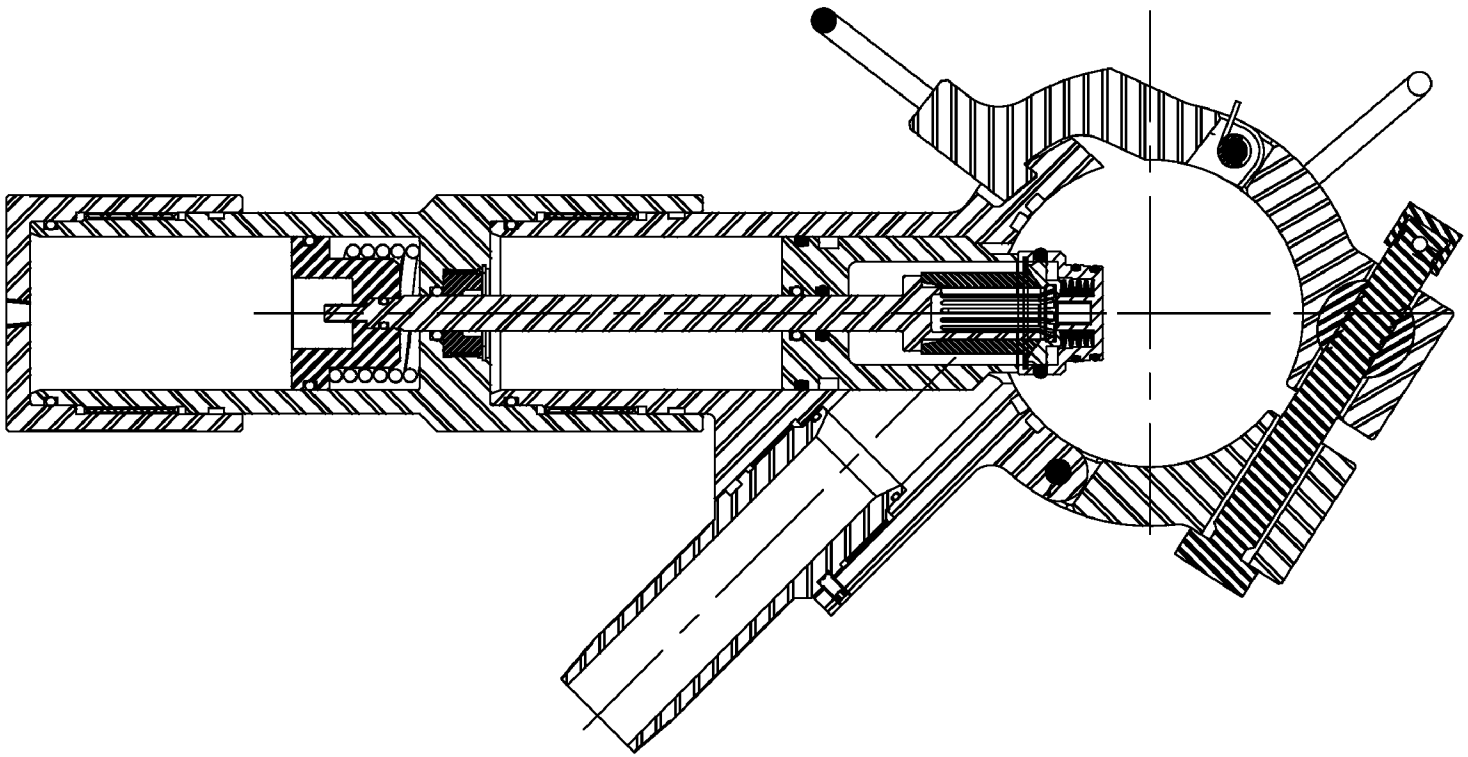

FIG. 4B is a side elevation of a telescoping arm 450 for supporting the clamp 300, according to another embodiment of the present invention. FIG. 4C is a top plan view of the telescoping arm 450. FIG. 4D is an end view taken on line 4D-4D of FIG. 4B. The telescoping arm 450 may include a piston and cylinder assembly (PCA) 451 and a mounting assembly 452.

The PCA 451 may include a two stage hydraulic piston and cylinder 453 which is mounted internally of a telescopic structure which may include an outer barrel 454, an intermediate barrel 455 and an inner barrel 456. The inner barrel 456 may be slidably mounted in the intermediate barrel 455 which is, may be in turn, slidably mounted in the outer barrel 454. The mounting assembly 452 may include a bearer 457 which may be secured to a beam by two bolt and plate assemblies 458. The bearer 457 may include two ears 459 which accommodate trunnions 460 which may project from either side of a carriage 461.

A hydraulic conduit (not shown) for each port of the clamp 300 may be formed through the barrels 454-456. The hydraulic conduits may terminate at each end of the PCA 451 into hoses with fittings. In this manner, the arm 450 may be connected to beams of the derrick 1 and the clamp 300 and the fittings respectively connected to hydraulic lines of a controller (FIG. 6A) and the clamp 300. Alternatively, the arm may be supported from a post anchored to a floor of the derrick. In this alternative, a base may be connected to the post. The arm may be supported from the base so that the arm may be rotated relative to the base (in a horizontal plane), such as by a piston and cylinder assembly (PCA). Further, the arm may also be pivoted relative to the base in a vertical plane by a second PCA. Such a configuration is discussed and illustrated in the '490 publication, incorporated above.

The mounting assembly 452 may include a clamp 462 bolted to the top of the carriage 461. In use, the mounting assembly 452 may be first secured to a convenient support beam in the drilling rig 1 by bolt and plate assemblies 458. If necessary a support beam may be mounted in the derrick for this purpose. The PCA 451 may then be mounted on the carriage 461 and clamped in position. The clamp 300 may then be hung from the free end 463 of the PCA 451 which is moved with respect to the mounting assembly 452 so that, at full extension, the clamp is in the desired position with respect to the CFS 200.

In normal use the clamp 300 may be moved towards and away from the CFS 200 by extending and retracting the hydraulic piston and cylinder 453. The outer barrel 454, intermediate barrel 455 and inner barrel 456 extend and contract with the hydraulic piston and cylinder 453 and provide lateral rigidity to the structure. At full extension the PCA 451 may be deflected from side to side by a small amount. This movement can readily be accommodated by the two stage hydraulic piston and cylinder 453 although, if desired, the ends thereof could be mounted on, for example, ball and socket joints or resilient mountings.

When the PCA 451 is fully retracted, the free end 463 may lie immediately adjacent the extremity 464 of the outer barrel 454. The clamp assembly 462 may be slackened, the piston and cylinder 451 slid on the carriage 461 until the extremity 464 lies adjacent the mounting assembly 452 and the clamp assembly 462 re-tightened. When the PCA 451 is fully contracted the free end 463 of the PCA 451 may lie closely adjacent the mounting assembly 452 with the clamp 300 therebelow. The PCA 451 may lie on an upwardly extending axis and a major portion of the PCA 451 may lie to the rear of the mounting assembly 452. In this position, the clamp 300 may rest on the rig floor. Alternatively, the clamp 300 may be suspended from an overhead cable whilst the PCA 451 again lies along an upwardly extending axis.

Alternatively, a motor could be provided to move the PCA 451 with respect to the mounting assembly 452. A swivel may be provided between the outer barrel 454 and the mounting assembly 102 or incorporated into the mounting assembly 452 itself to be capable of swiveling movement.

FIGS. 5A-5E are cross-sectional views of the CFS plug 250 and clamp 300 in various operational positions. Once a stand or joint needs to be added or removed to/from the drill string 8, the drill string may be supported from the rig floor, such as by setting slips. The clamp 300 may be transported into position adjacent the CFS 200 and operated to the closed and engaged positions. Hydraulic fluid may then be injected into the hydraulic port 337, thereby overcoming the spring 331 and longitudinally moving the retrieval piston 301, rod 305, sleeve 326, and collet 335 toward the CFS 200 (only plug 250 shown). As the retrieval piston 301 moves toward the plug 250, the collet fingers may engage the profile 252*p* and the sleeve 326 may engage the shoulder 252*is* and push the locking sleeve shoulder 252*os* toward the shoulder 251*is*. Once the shoulder 252*os* has been pushed so that the recess 252*r* is aligned with the balls 256, drilling fluid pressure in the CFS 200 may push the plug body 251 toward the sleeve 326, thereby causing the balls 256 to retract from the groove 201*g* and freeing the plug 250 from the housing 200. Drilling fluid pressure may also push the retaining piston 302 into engagement with the partition.

Pressure may then be relieved from the hydraulic port 337, thereby allowing the spring 331 to push the retrieval piston 301 toward the cap 303. Since the collet 335 is in engagement with the profile 252*p*, the plug 250 is also transported from the port 201. Once the plug 250 is removed, drilling fluid may be injected through the nipple 327 and the stand/joint may be added/removed to/from the drill string. To return the plug, hydraulic fluid may again be injected into the hydraulic port 337, thereby overcoming the spring 331 and longitudinally moving the plug toward the port 201. The plug may be moved until the shoulder 251*os* seats against the shoulder 201*s*. Hydraulic fluid may then be injected into the hydraulic port 338, thereby longitudinally moving the retaining piston 302 toward the plug 250.

The retaining piston 302 may be moved until the retaining piston lip seats against an end of the plug body 251. With the plug body held in place by the retaining piston 302, pressure may be relieved from the hydraulic port 337, thereby allowing the spring 331 to retract the collet 335 and sleeve 326. Retraction of the collet and the sleeve 326 may allow the spring 255 to move the locking sleeve 252 toward the snap ring 254, thereby allowing an inclined outer surface of the locking sleeve to push the balls 256 from the recess 252*r* into the groove 201*g*, thereby locking the plug 250 into the port 201. Once the locking sleeve 252 engages the snap ring, the sleeve 326 may disengage the shoulder 252*is* and the collet 335 may disengage the profile. The retrieval piston 301 may retract until the shoulder thereof seats against the retaining piston shoulder. Fluid pressure may then be relieved from the hydraulic port 338, thereby allowing the retrieval piston 301 to return. The clamp 300 may then be disengaged, opened, and transported away from the CFS.

Figure 6A:
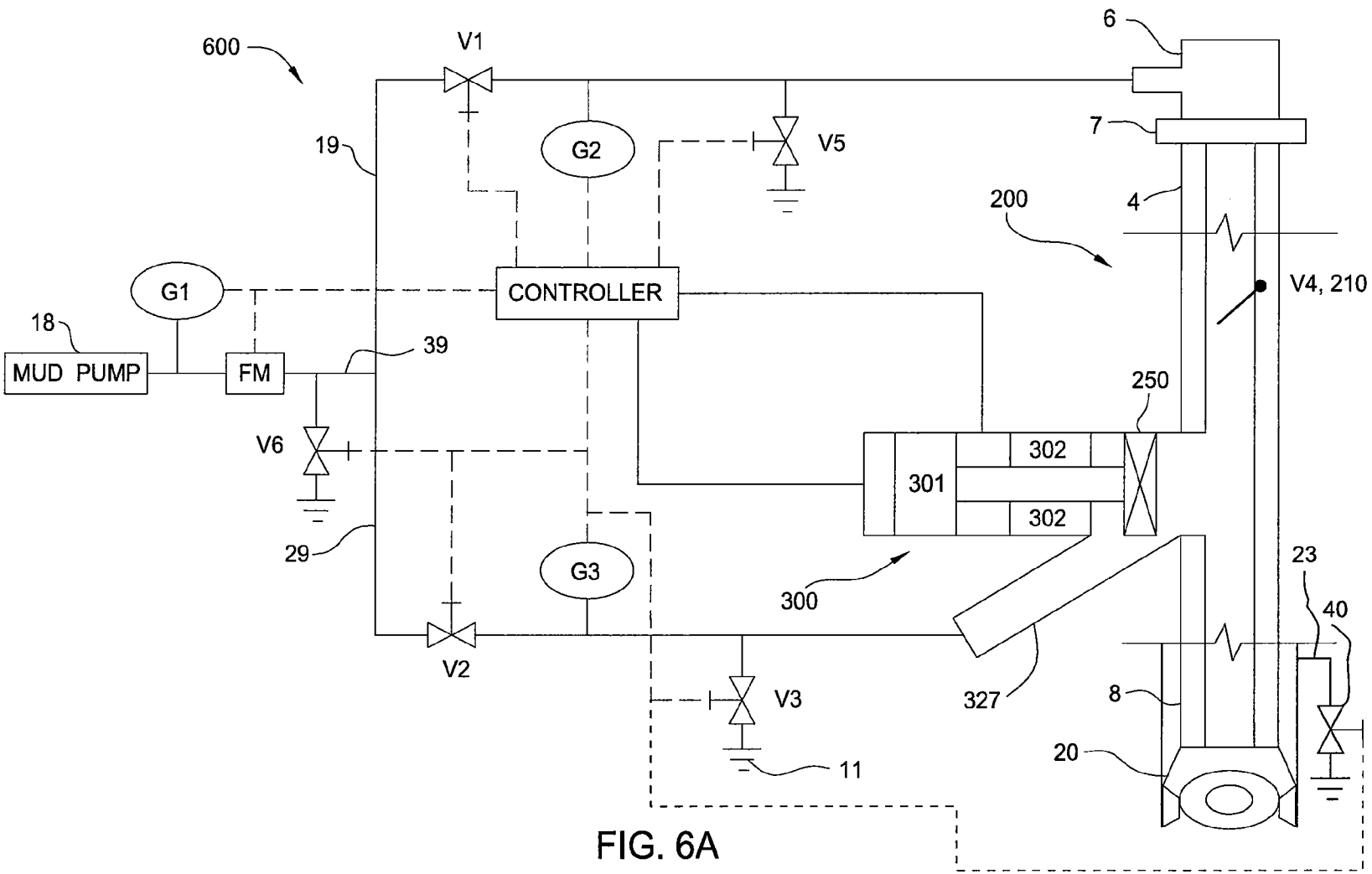
FIG. 6A is a flow diagram of the CFS, clamp, and control system.
Figure 6C:
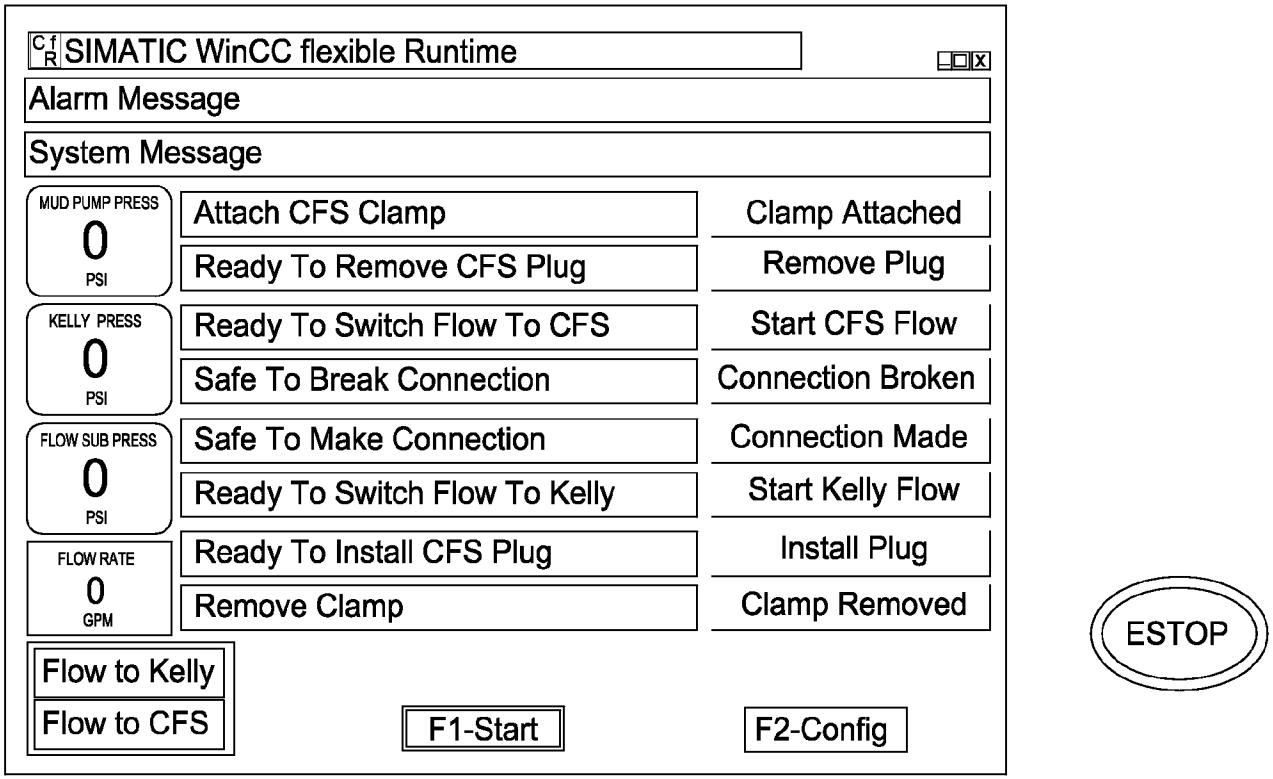
FIG. 6C illustrates a controller display for operation of the CFS and clamp.

FIG. 6A is a flow diagram of the CFS, clamp, and a control system 600. FIG. 6B is a table illustrating valve positions for operational acts of adding/removing joints/stands to/from the drill string while circulating through the drill string. FIG. 6C illustrates a controller interface for operation of the CFS and clamp. The control system 600 may include a controller, one or more pressure sensors G1-G3, a flow meter FM, and one or more control valves V1-V3, V5, V6. Control Valves V1, V2 may be the simple open/closed type, such as ball or butterfly, or they may be metered type, such as needle. If control valves V1 and V2 are metered valves, the controller may gradually open or close them, thereby minimizing pressure spikes or other deleterious transient effects. Pressure sensors G1-G3 may be respectively disposed in the header 39, the Kelly/top drive line 19, and the clamp line 29. The flow meter may be disposed in the header 39. The pressure sensors G1-G3 and flow meter FM may be in electrical communication with the controller. The controller may be microprocessor based and may include a hydraulic pump, solenoid valves, and an analog and/or digital user interface. The controller may be in hydraulic communication with the control valves V1-V3, V5, V6 and the ports 337, 338. Alternatively, the control valves V1-V3, V5, V6 may be pneumatically or electrically actuated.

Referring to the prior art system of FIG. 1, the operator may be at risk when removing the plug 27. If the integrity of the flapper 12 of the prior art system is compromised, high pressure drilling fluid may be discharged when the plug 27 is removed, thereby striking and injuring the operator. In contrast, the controller interface may be located in a rig control room so that the operator may remotely operate the clamp 300 once the clamp is closed and engaged. Further, as discussed in alternatives above, the clamp may include jaws and/or a hydraulic transport arm so that the clamp may even be remotely transported to/from the CFS 200, closed/opened, and engaged/disengaged from the safety of the rig control room.

During drilling, the mud pump injects drilling fluid, such as mud, through the Kelly 4 or top drive connected to a top or surface end of the drill string 8. The valves V1, V3, and V4 may be open. When a stand of pipe needs to be added to the drill string 8, the drill string 8 is raised and the spider set. The operator may then push the start button and the controller may illuminate the "Attach CFS Clamp" indicator. The clamp 300 may be transported to the CFS, closed, and engaged by the operator. The operator may maintain or substantially maintain the current mud pump flow rate or change the mud pump flow rate. The change may be an increase or decrease. The operator may then push the "Clamp Attached" Button.

The controller may then warn the operator of injury should the clamp not be securely connected. The operator may verify the warning. The controller may then close valve V3 and apply pressure to the flow nipple 327 by opening valve V2 and then closing valve V2. If the clamp is not securely engaged, drilling fluid will leak past the seals 333. The controller may verify sealing integrity by monitoring pressure sensor G3. Alternatively or additionally, the clamp may include one or more sensors operable to detect proper closure of the clamp and/or engagement of the clamp 300 with the CFS housing 250. The sensors may be in electrical communication with the controller. For example, a first sensor may detect engagement of the locators 329 with the openings 202 a second sensor may detect tension in the clamp bands 318, 319, and a third sensor may detect engagement of the profiles 320*p*, 322*p*. If the controller detects improper position or engagement of the clamp from any of the sensors, the controller may not proceed and generate an alarm message to the operator. The operator may then take remedial action.

The controller may then relieve pressure from the nipple 327 by opening valve V3. The controller may then close valve V3. The controller may then illuminate the "Ready to Remove CFS Plug" indicator. The operator may confirm by pushing the "Remove Plug" Button. The controller may then supply hydraulic fluid to the retrieval piston 301 via port 337 and then relieve pressure from the hydraulic port 337, thereby removing the CFS plug 250, as discussed above. Once the plug 250 is removed, the controller may verify removal by monitoring G3 and illuminate "Ready to Switch Flow to CFS". The operator may confirm by pushing the "Start CFS Flow" button. The controller may then open valve V2 to inject the drilling fluid through flow nipple 327 and into the drill string through the port 201. Pressure may then equalize and allow the spring 223 to move the poppet 220 into the closed position, thereby closing the float valve 210/V4. The controller may then close valve V1 and open valve V5, thereby relieving pressure from the top drive or Kelly swivel 7. The controller may verify that the float valve 210N4 is closed by monitoring pressure sensor G2.

The controller may then illuminate the "Safe to Break Connection" indicator. The operator may then break the connection between the Kelly 4/top drive and press the "Connection Broken" button. The operator may then raise the Kelly 4/top drive, engage a stand/joint, and hoist the stand/joint into position to be made up with the CFS 200. During this process, the controller may monitor the pressure sensors G1-G3 and the flow meter FM to verify proper operation. The controller may then illuminate the "Safe to Make Connection" indicator. The operator may then make up the connection between the stand/joint and CFS 200, make up the connection between the Kelly 4/top drive and the stand/joint, and press the "Connection Made" button. The controller may then close valve V5 and illuminate the "Ready to Switch Flow to Kelly" indicator. The operator may then press the "Start Kelly Flow" button. The controller may open the valve V1, thereby allowing drilling fluid flow from the mud pump 18, through the line 19, and into the top drive or Kelly swivel 7. The float valve V4/210 may open in response to drilling fluid flow through the top drive or Kelly swivel 7.

The controller may verify opening of the valve V1 by monitoring the pressure sensor G2. The controller may then close valve V2 and illuminate the "Ready to Install CFS Plug" indicator. The operator may confirm by pressing the "Install Plug" button. The controller may then supply hydraulic fluid to the port 337, thereby moving the retrieval piston 301 and placing the plug 250 into the port 201. The controller may then supply hydraulic fluid to the port 338, thereby moving the retaining piston 302 into engagement with the plug 250. The controller may then relieve pressure from the hydraulic port 337, thereby disengaging the retrieval piston 301. The controller may then relieve pressure from the hydraulic port 338, thereby disengaging the retaining piston 302. The controller may then relieve pressure from the flow nipple by opening valve V3. The controller may then close valve V3 and test plug integrity by opening and closing valve V2 and monitoring pressure sensor G3. The controller may then relieve pressure from the flow nipple by opening valve V3.

The controller may then illuminate the "Remove Clamp" indicator. The operator may disengage the clamp, open the clamp, and transport the clamp away from the CFS. The operator may confirm by pressing the "Clamp Removed" Button. The operator may disengage the slips, return the mud pump flow rate (if it was changed from the drilling flow rate), and resume drilling. The added stand/joint may include an additional CFS 200 connected at a top thereof so that the process may be repeated when an additional joint/stand needs to be added. A similar process may be employed if/when the drill string needs to be tripped, such as for replacement of the drill bit 20. If, at any time, a dangerous situation should occur, the emergency stop ESTOP button may be pressed, thereby opening the vent valves V3, V5, V6 and closing the supply valves V1 and V2, (some of the valves may already be in those positions). If the interface is digital, the ESTOP button may be a mechanical button separate from the controller display or the ESTOP may be integrated with the display.

Figure 7:
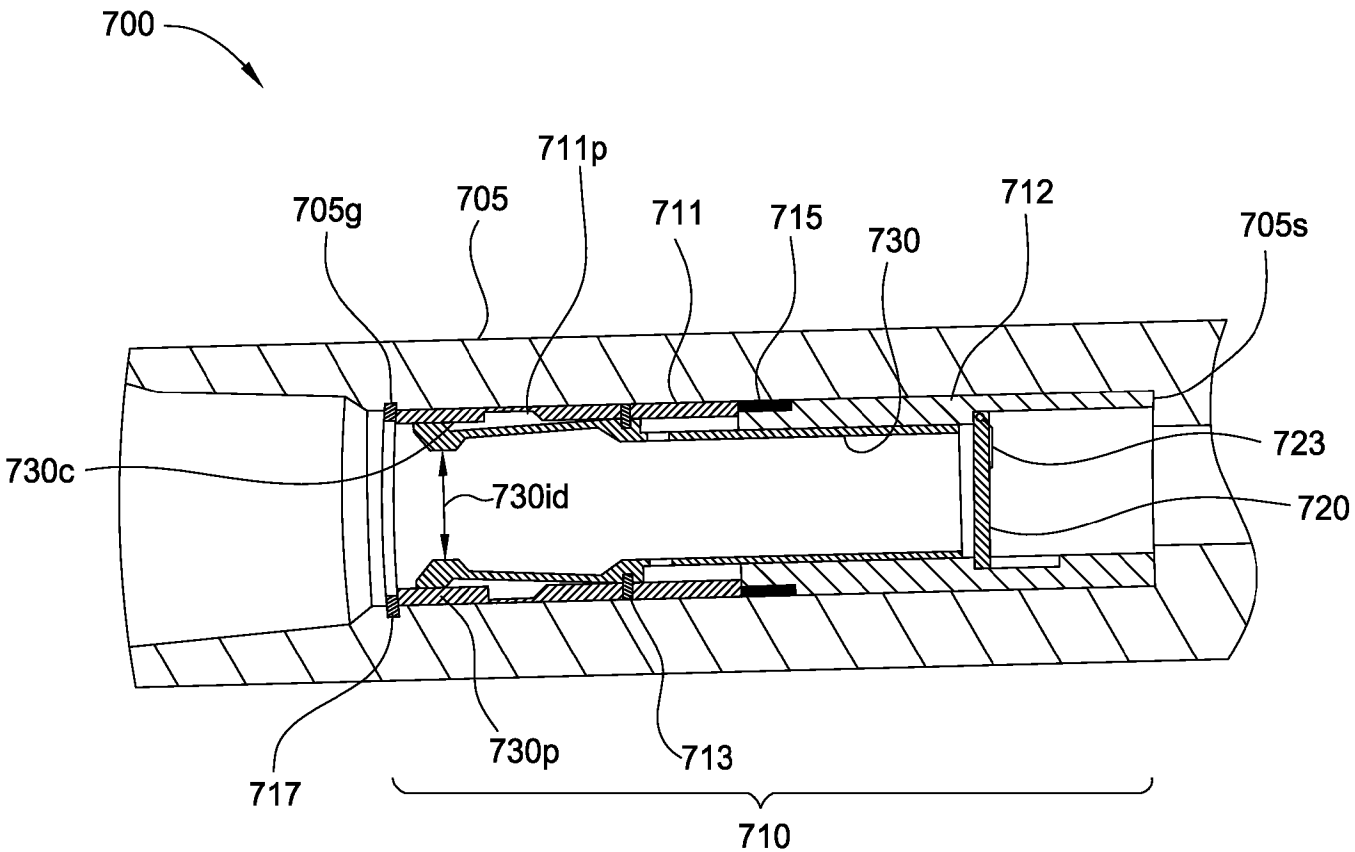
FIG. 7 is a cross-sectional view of a portion of a CFS, according to another embodiment of the present invention.

FIG. 7 is a cross-sectional view of a portion of a CFS 700, according to another embodiment of the present invention. The CFS 700 may be similar to the CFS 200 except for the substitution of respective lock-open float valve 710 for the float valve 210 and accompanying modifications to the CFS housing 205 (now 705). Relative to the housing 205, the housing 705 may omit the profile 203. Instead, a recess may be formed in an inner surface thereof and terminate at a shoulder 705*s*. A groove 705*g* may be formed in the recess and receive a fastener, such as snap ring 717. The float valve 710 may be longitudinally coupled to the housing 705 by disposal between the snap ring 717 and the shoulder 705*s* and may include a latch mandrel 711, a valve mandrel 712, a valve member, such as a flapper 720, and a valve actuator, such as a flow tube 730.

The latch mandrel 711 may be an annular member and may have a profile 711*p* formed in an inner surface thereof. The valve mandrel 712 may be disposed longitudinally adjacent to the latch mandrel 711. The seal 715 may be disposed along an outer surface of the valve mandrel. The seal 715 may be similar to the seal 215. The flapper 720 may be pivoted to the valve mandrel 712 and may be biased toward the closed position by a biasing member, such as a torsion spring 723. The flow tube 730 may be disposed along an inner surface of the latch mandrel 711 and the valve mandrel 712. The flow tube may be selectively longitudinally coupled to the latch mandrel 711 by one or more frangible members, such as shear screws 713. A collet 730*c* may be formed at a first longitudinal end of the flow tube 730 and may include one or more fingers. Each finger may include an inner profile and an outer profile 730*p*. The inner profile may define a reduced diameter 730*id* and the outer profile may correspond to the profile 711*p*.

During normal operation, the float valve 710 functions similarly to the float valve 210. However, if a well control situation should develop, a lock-open tool (not shown) may be deployed using a deployment string, such as wireline. The lock-open tool may include a plug having an outer diameter slightly larger than the reduced diameter 730*id* of the collet 730*c* inner profile and a shaft extending from the plug. The plug may have a tapered shoulder corresponding to a tapered shoulder of the collet inner profile. The plug may seat against the tapered shoulder and the shaft may push the flapper at least partially open, thereby equalizing pressure across the flapper. Weight of the plug may be applied to the tapered shoulder by relaxing the wireline or fluid pressure may be exerted on the plug from the surface.

The shear screws 713 may then fracture allowing the flow tube 730 to be moved longitudinally relative to the latch mandrel and valve mandrel until the profile 730*p* engages the profile 711*p*, thereby expanding the reduced diameter 730*id* of the collet inner profile. The plug outer diameter may be less than the expanded inner profile diameter, thereby allowing the plug to pass through the collet 730*c*, the rest of the flow tube, and the valve mandrel 712. Movement of the flow tube may also cause a second end of the flow tube to engage the flapper 720 and hold the flapper in the open position. The operation may be repeated for every CFS 700 disposed along the drill string. In this manner, every CFS 700 in the drill string may be locked open in one trip. Remedial well control operations may then be conducted through the drill string in the same trip or retrieving the wireline to surface and changing tools on the wireline for a second deployment.

Alternatively, instead of employing the snap ring 717 to retain the latch mandrel 711 in the housing 705, an inner surface of the housing recess may be threaded and receive a threaded outer surface of the latch mandrel.

FIGS. 8A-8E are cross-sectional views of wellbores 800, 810, 820, 830 being drilled with drill strings 802 employing downhole CFSs 805, 825, 835, according to other embodiments of the present invention.

Figure 8A:
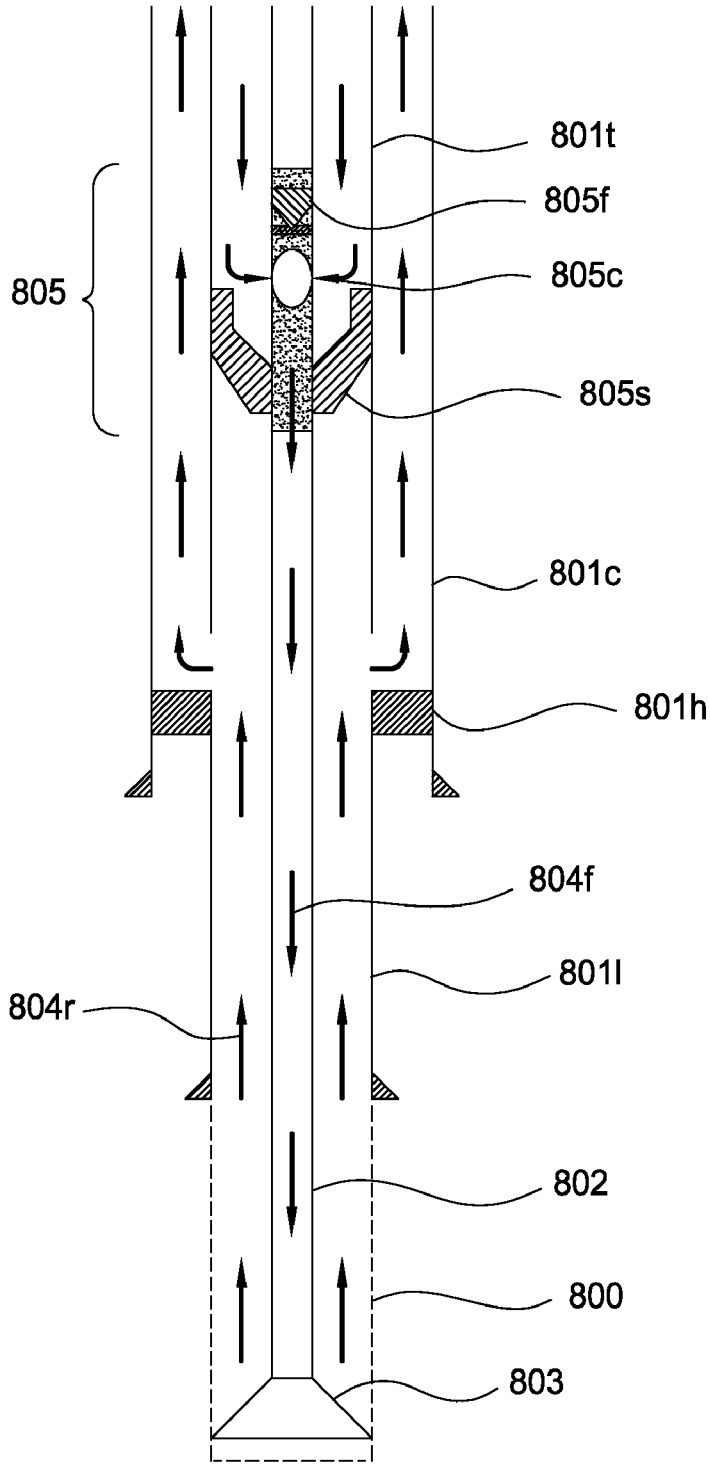
FIGS. 8A-8E are cross-sectional views of wellbores being drilled with drill strings employing downhole CFSs, according to other embodiments of the present invention.

Referring to FIG. 8A, the wellbore 800 may have a tubular string of casing 801*c* cemented therein. A tubular liner string 801*l* may be hung from the casing 801*c* by a liner hanger 801*h*. The liner hanger may include a packer for sealing the casing-liner interface. The liner 801*l* may be cemented in the wellbore 800. A tieback casing string 801*t* may be hung from a wellhead (not shown, see FIG. 1) and may extend into the wellbore 800 proximately short of the hanger 801*h* so that a flow path is defined between the distal end of the tieback string 801*t* and the liner hanger 801*h* or top of the liner 801*l*. Alternatively, a parasite string may be used instead of the tieback string 801*t*. A drill string 802 may extend from a top drive or Kelly located at the surface (not shown, see FIG. 1). The drill string 802 may include a drill bit 803 located at a distal end thereof and a CFS 805.

The CFS 805 may include a housing similar to one of the housings 205, 705. The housing may be tubular and have a longitudinal flow bore therethrough and a radial port through a wall thereof. A float valve 805*f* may be disposed in the housing bore and may be similar to one of the float valves 210, 710. A check valve 805*c* may be disposed in the housing port. The check valve 805*c* may be operable between an open position in response to external pressure exceeding internal pressure (plus spring pressure) and a closed position in response external pressure being less than or equal to internal pressure. The check valve 805*c* may include a body, one or more seals for sealing the housing-port interface, a valve member, such as a ball, flapper, poppet, or sliding sleeve and a spring disposed between the body and the valve member for biasing the valve member toward a closed position. The check valve 805*c* may be any of the check valves illustrated in and discussed with reference to FIGS. 11A or 11C, below.

The CFS 805 may further include an annular seal 805*s*. The annular seal 805*s* may engage an outer surface of the CFS housing and an inner surface of the tie-back string 805*t* so that an upper portion of an annulus formed there-between is isolated from a lower portion thereof. The annular seal 805*s* may be longitudinally positioned below the check valve 805*c* so that the check valve is in fluid communication with the upper annulus portion. A cross-section of the annular seal may take any suitable shape, including but not limited to rectangular or directional, such as a cup-shape. The annular seal 805*s* may be configured to engage the tie-back string only when drilling fluid is injected into the tie-back/drill string annulus, such as by using the directional configuration. The annular seal may be rotationally coupled to the drill string or the annular seal may be part of a seal assembly that allows rotation of the drill string relative thereto.

The seal assembly may include the annular seal, a seal mandrel, and a seal sleeve. The seal mandrel may be tubular and may be connected to the CFS housing by a threaded connection. The seal sleeve may be longitudinally coupled to the seal mandrel by one or more bearings so that the seal sleeve may rotate relative to the seal mandrel. The annular seal may be disposed along an outer surface of the seal sleeve, may be longitudinally coupled thereto, and may be in engagement therewith. An interface between the seal mandrel and seal sleeve may be sealed with one or more of a rotating seal, such as a labyrinth, mechanical face seal, or controlled gap seal. For example, a controlled gap seal may work in conjunction with mechanical face seals isolating a lubricating oil chamber containing the bearings. A balance piston may be disposed in the oil chamber to mitigate the pressure differential across the mechanical face seals.

Additionally, the CFS port may be configured with an external connection. The external connection may be suitable for the attachment of a hose or other such fluid line. The annular seal 805*s* may also function as a stabilizer or centralizer.

The CFS 805 may be assembled as part of the drill string 802 within the wellbore 800. Once the CFS 805 is within the tie-back string 805*t*, drilling fluid 804*f* may be injected from the surface into the tieback/drill string annulus. The drilling fluid 804*f* may then be diverted by the seal 805*c* through the check valve 805*c* and into the drill string bore. The drilling fluid may then exit the drill bit 803 and carry cuttings from the bottomhole, thereby becoming returns 804*r*. The returns 804*r* may travel up the open wellbore/drill string annulus and through the liner/drill string annulus. The returns 804*r* may then be diverted into the casing/tie-back annulus by the annular seal 805*s*. The returns 804*r* may then proceed to the surface through the casing/tie-back annulus. The returns may then flow through a variable choke valve (not shown), thereby allowing control of the pressure exerted on the annulus by the returns.

Inclusion of the additional tie-back/drill string annulus obviates the need to inject drilling fluid through the Kelly/top drive. Thus, joints/stands may be added/removed to/from the drill string 802 while maintaining drilling fluid injection into the tie-back/drill string annulus. Further, an additional CFS 805 is not required each time a joint/stand is added to the drill string. During drilling, drilling fluid may be injected into the Kelly/top drive and/or the tie-back/drill string annulus. If drilling fluid is injected into only the Kelly/top drive, the drilling fluid may be diverted to the tie-back/drill string annulus when adding/removing a joint/stand to/from the drill string. The tie-back/drill string annulus may be closed at the surface while drilling. If drilling fluid is injected into only the tie-back/drill string, injection of the drilling fluid may remain constant regardless of whether drilling or adding/removing a stand/joint is occurring.

Figure 8B:
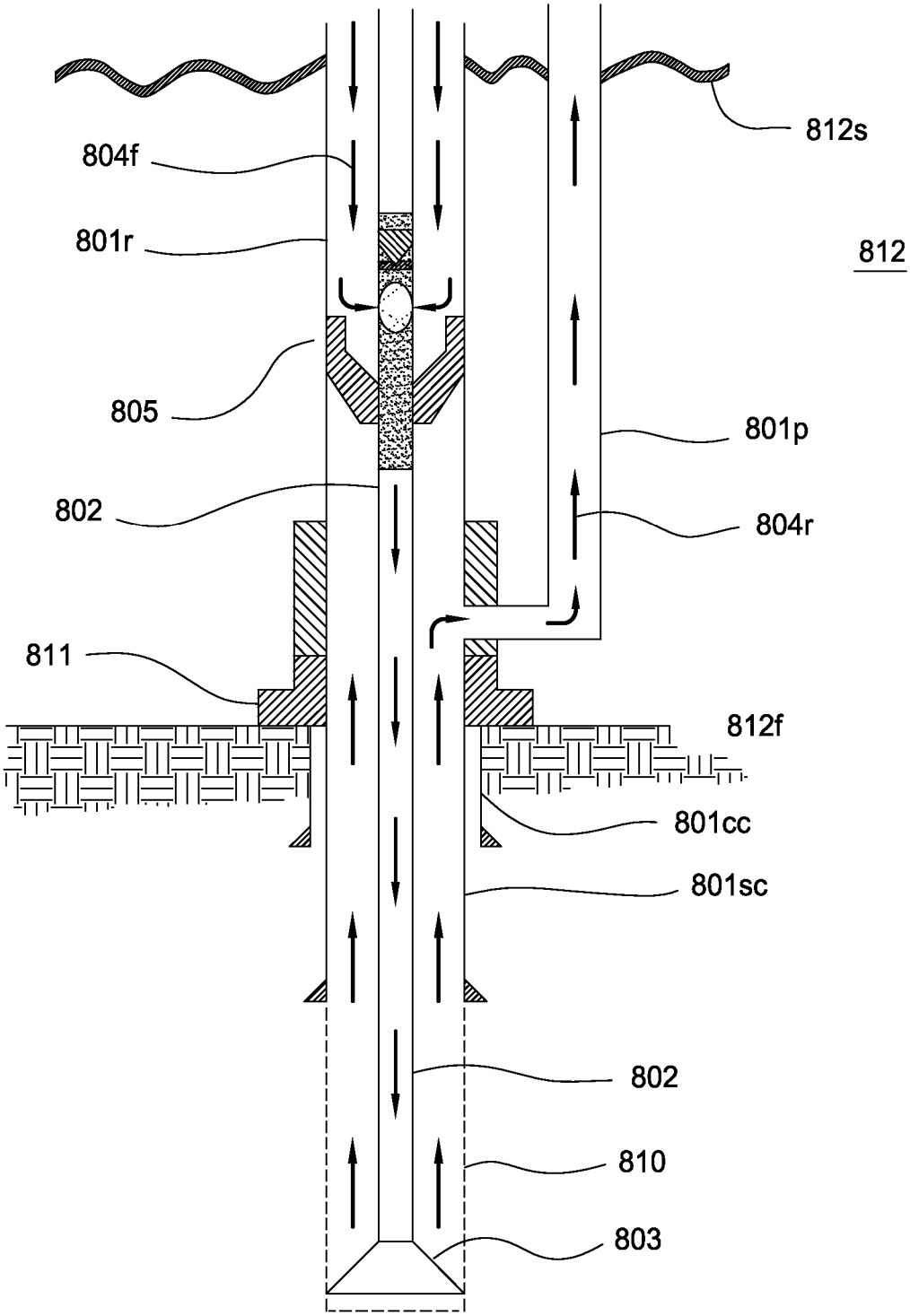

Referring to FIG. 8B, the CFS 805 may also be deployed for drilling a wellbore 810 below a surface 812*s* of the sea 812. A tubular riser string 801*r* may connect a fixed or floating drilling rig (not shown), such as a jack-up, semi-submersible, barge, or ship, to a wellhead 811 located on the seafloor 812*f*. A conductor casing string 801*cc* may extend from the wellhead 811 and may be cemented into the wellbore. A surface casing string 801*sc* may also extend from the wellhead 811 and may be cemented into the wellbore 810. A tubular return string 801*p* may be in fluid communication with a riser/drill string annulus and extend from the wellhead 811 to the drilling rig. The riser/drill string annulus may serve a similar function to the tie-back/drill string annulus discussed above. The surface casing string/drill string annulus may serve a similar function to the liner/drill string annulus, discussed above. The returns 804*r*, instead of being diverted into the casing/tie-back annulus may be instead diverted into the return string.

Alternatively, the riser string may be concentric, thereby obviating the need for the return string 801*p*. A suitable concentric riser string is illustrated in FIGS. 3A and 3B of International Patent Application Pub. WO 2007/092956 , hereinafter '956 PCT), which is herein incorporated by reference in its entirety. The concentric riser string may include riser joints assembled together. Each riser joint may include an outer tubular having a longitudinal bore therethrough and an inner tubular having a longitudinal bore therethrough. The inner tubular may be mounted within the outer tubular. An annulus may be formed between the inner and outer tubulars.

Figure 8C:
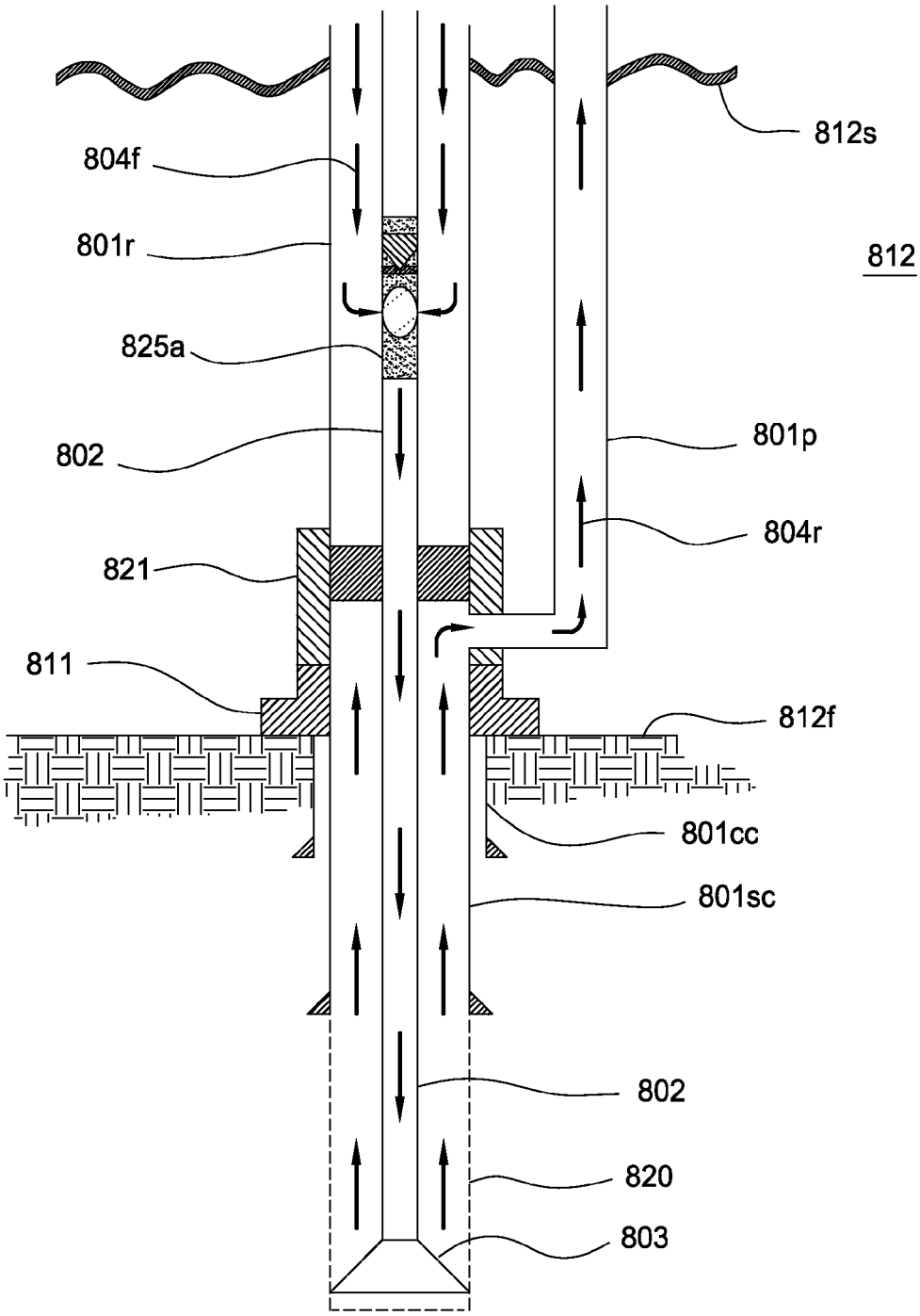
Figure 8D:
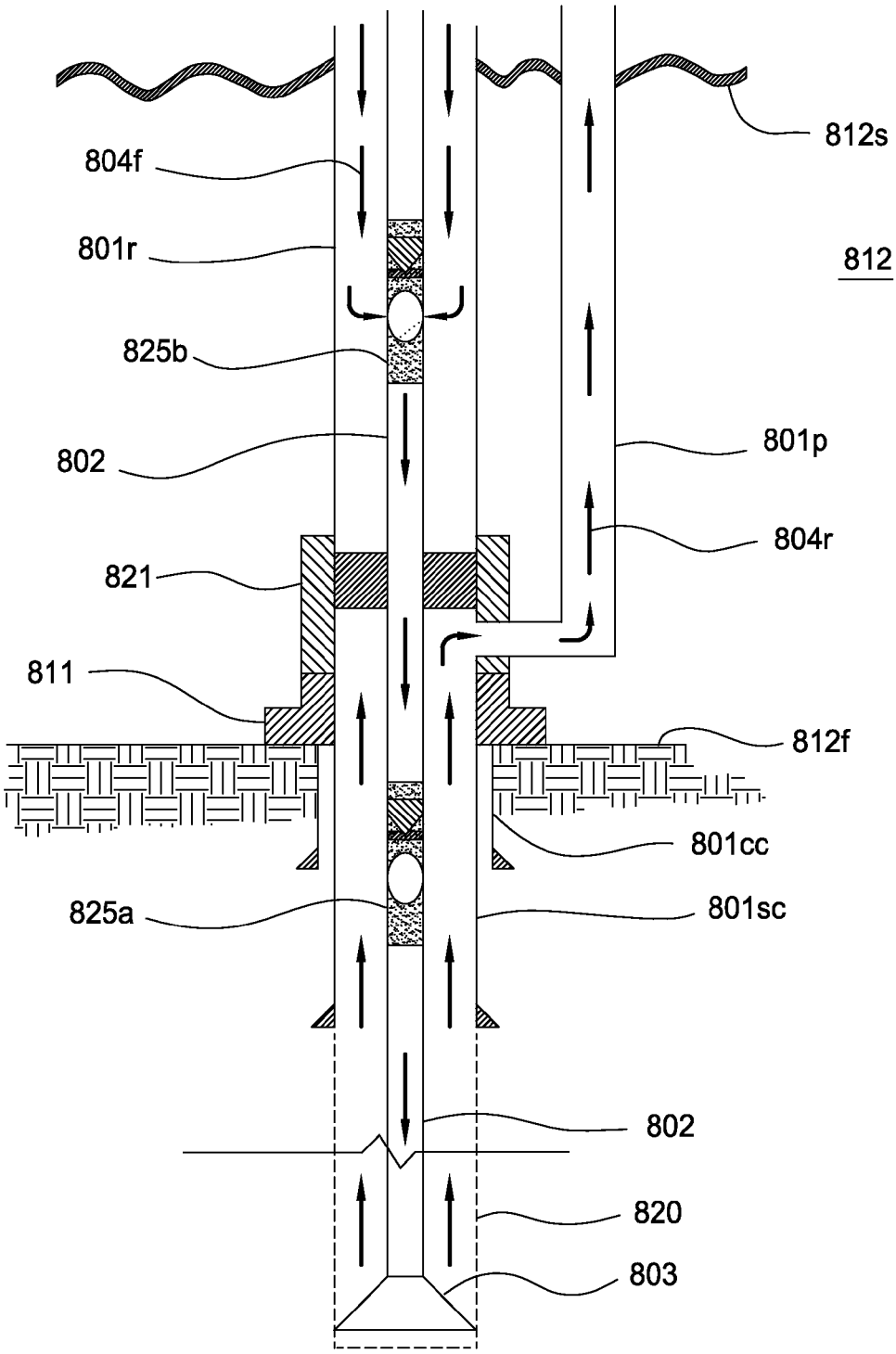

Referring to FIG. 8C, the subsea wellbore 820 may be drilled using the CFS 825*a* instead of the CFS 805. The CFS 825*a* may differ from the CFS 805 by removal of the annular seal 805*s*. Instead, a rotating control device (RCD) 821 may be used to divert the drilling fluid 904*f* into the drill string and the returns 804*r* into the returns string 801*p*. A suitable RCD is illustrated in FIG. 8D of the '956 PCT except that the annular seals 182, 184 may be inverted. Instead of longitudinally moving with the drill string 802, the RCD 821 may be longitudinally connected to the wellhead 811. Alternatively, an active seal RCD may be used.

The RCD 821 may include an upper head and a lower body with an outer body or first housing therebetween. A piston may have a lower wall moveable relative to the first housing between a sealed position and an open position, where the piston may move downwardly until the end engages the shoulder. In this open position, an annular packer or seal may be disengaged from the internal housing while the wall blocks a discharge outlet. The internal housing may include a continuous radially outwardly extending upset or holding member proximate to one end of the internal housing. When the seal is in the open position, the seal may provide clearance with the holding member. The upset may be fluted with one or more bores to reduce hydraulic pistoning of the internal housing. The other end of the internal housing may include threads. The internal housing may include two or more equidistantly spaced lugs.

The bearing assembly may include a top rubber pot that is sized to receive a top stripper rubber or inner member seal. A bottom stripper rubber or inner member seal may be connected with the top seal by the inner member of the bearing assembly. The outer member of the bearing assembly may be rotationally coupled with the inner member. The outer member may include two or more equidistantly spaced lugs The outer member may also include outwardly-facing threads corresponding to the inwardly-facing threads of the internal housing to provide a threaded connection between the bearing assembly and the internal housing.

Both sets of lugs may serve as guide/wear shoes when lowering and retrieving the threadedly connected bearing assembly and internal housing. Both sets of lugs may also serve as a tool backup for screwing the bearing assembly and housing on and off. The lugs on the internal housing may engage a shoulder on the riser to block further downward movement of the internal housing and the bearing assembly. The drill string 802 may be received through the bearing assembly so that both inner seals may engage the drill string. Secondly, the annulus between the first housing and the riser and the internal housing may be sealed using a seal. These above two seals may provide a desired barrier or seal in the riser both when the drill string is at rest or while rotating.

FIG. 8D illustrates the bottom of the wellbore 820 extended to a second, deeper depth relative to FIG. 8C. Once the CFS 825*a* nears the RCD 821, a second CFS 825*b* may be added to the drill string 802. The second CFS 825*b* may continue the function of the CFS 825*a*. Once drilling fluid 804*f* is diverted into the drill string 802, the drilling fluid may open the float valve 805*f* in the CFS 825*a* and close the check valve 805*c* in the CFS 825*a*. Since the CFS 825*a* may not include the annular seal 805*s*, the CFS 825*a* may pass through the RCD 821 unobstructed.

Figure 8E:
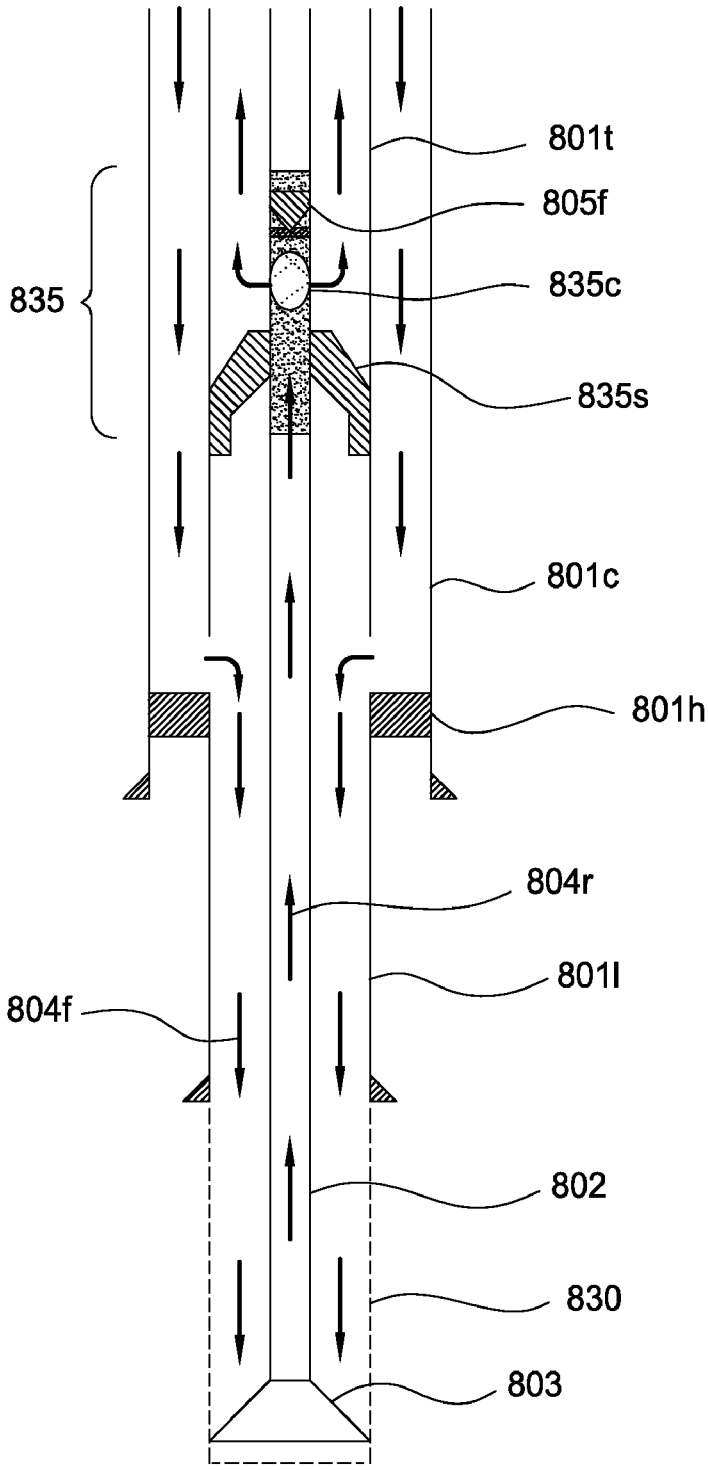

FIG. 8E illustrates a wellbore 830 similar to the wellbore 800 except that circulation has been reversed. The CFS 835 may be similar to the CFS 805 except that the check valve 835*c* may be inverted relative to the check valve 805*c* and the annular seal 835*s* (if directional) may be inverted relative to the annular seal 805*s*. Drilling fluid 804*f* may be injected from the surface into the casing/tie-back annulus. The drilling fluid 804*f* may proceed through the tie-back/liner flow path and be forced into the liner/drill-string annulus by the annular seal 805*s*. The drilling fluid may then carry cuttings from the bottomhole, thereby becoming returns 804*r*. The returns 804*r* may enter the drill bit 803 and proceed through the drill string 802 until the returns reach the float valve 805*f*. The closed float valve 805*f* may divert the returns through the check valve 835*c* and into the tie-back/drill string annulus. The returns 804*r* may then flow through the tie-back/drill string annulus to the surface.

Figure 9:
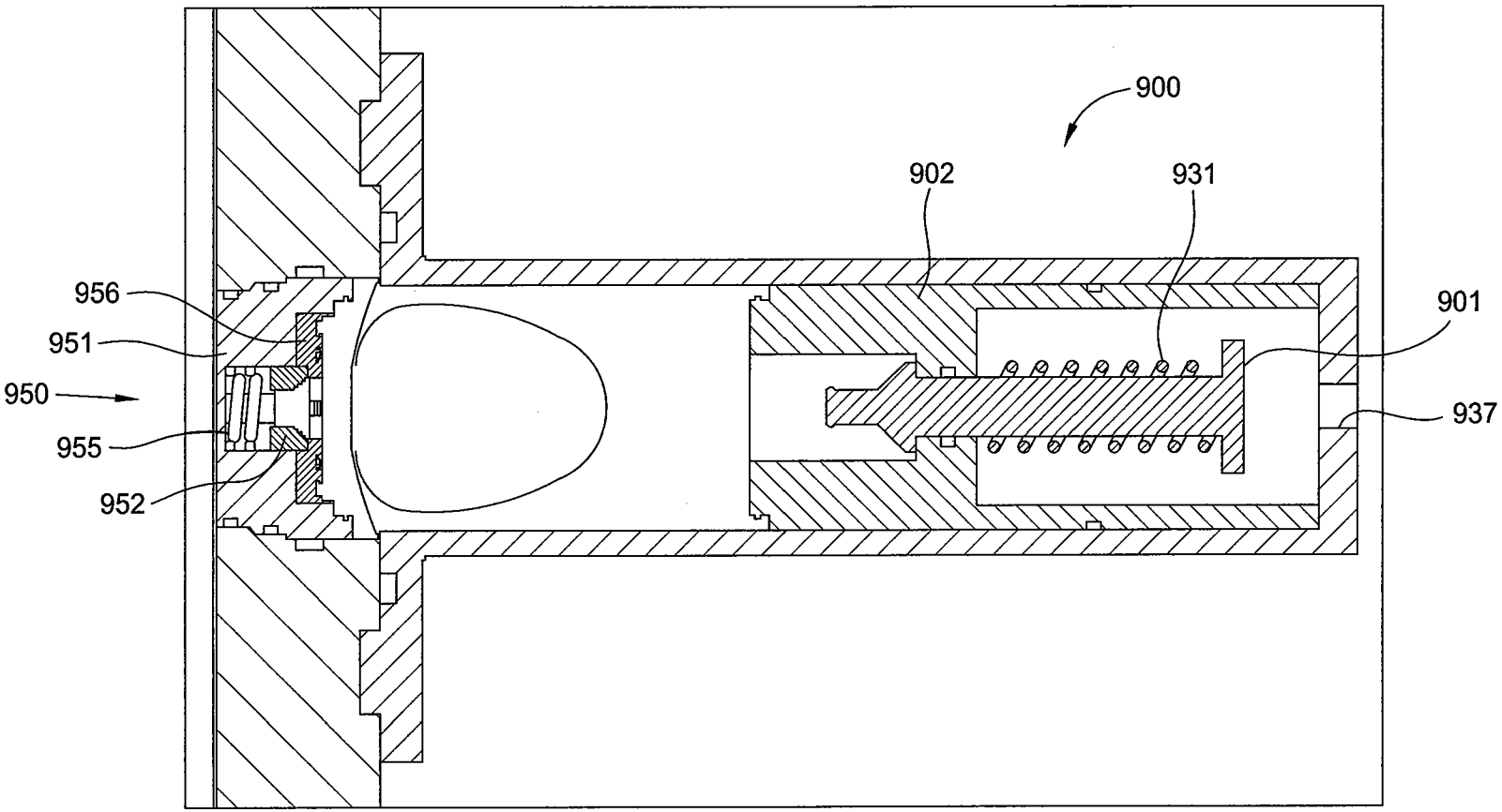
FIG. 9 is a cross-sectional view of a CFS plug and clamp, according to another embodiment of the present invention.

FIG. 9 is a cross-sectional view of a CFS plug 950 and clamp 900, according to another embodiment of the present invention. FIG. 9A is a top view of the plug 950. The plug 950 may be used in the port 201 of one of the CFSs 200, 700 instead of the plug 250 and the clamp 300 may be modified accordingly. Operational views of the plug 950 and clamp 900 may be found in FIGS. 3*a* -3*f* of the '434 provisional.

The plug 950 may include a body 951, a set of dogs 956 assembled in radial openings in the body, and a locking sleeve 952. The body 951 may have seals disposed in an outer surface thereof to engage the CFS housing. In the assembled position, the dogs 956 may spread out radially into a groove formed in the CFS housing port and may be held there by the locking sleeve 952. The dogs 956 may be biased inward by a circumferential spring and the locking sleeve 952 may be biased against the dogs by a second spring 955. The dogs 956 may serve to longitudinally couple the plug 950 to the CFS housing.

The clamp 900 may include an inner piston 901, an outer piston 902, and a spring 931 disposed between the pistons to remove and install the plug 950. The clamp may include only one hydraulic port 937 to operate both pistons. Hydraulic fluid may be injected into the port, thereby pushing the outer piston toward the plug. A profile formed in the outer surface of the outer piston may engage a spring-biased latch disposed, such as a snap ring, in an inner surface of the body. Continued injection of hydraulic fluid into the hydraulic port may push the inner piston toward the plug. The inner piston may push the locking sleeve against the locking sleeve spring, thereby releasing the dogs and allowing the dog spring to retract the dogs. Retraction of the dogs may free the plug from the CFS. An o-ring or a coil spring assembled on the dogs may cause movement of dogs toward the locking sleeve. After the dogs are retracted, the dogs may maintain the locking sleeve in a compressed state.

Hydraulic fluid may then be relieved from the hydraulic port. The inner piston may then move away from the plug. The outer piston may then move away from the CFS port, thereby carrying the plug. Drilling fluid may then be injected into the flow nipple. Pressure of drilling fluid flowing through the flow nipple may keep the outer piston away from the CFS housing. Once a joint/stand has been added/removed to/from the drill string, the plug may be installed. Hydraulic fluid may be injected into the port, thereby pushing the outer piston and the plug toward the CFS housing until the plug seats against the CFS port shoulder. Continued injection of hydraulic fluid into the hydraulic port may push the inner piston toward the plug. The inner piston may penetrate through the dogs, thereby radially displacing the dogs into the CFS housing port groove. The locking sleeve spring may move the locking sleeve into engagement with the dogs, thereby locking the dogs. Hydraulic fluid may then be relieved from the port, thereby retracting the pistons.

Figure 10:
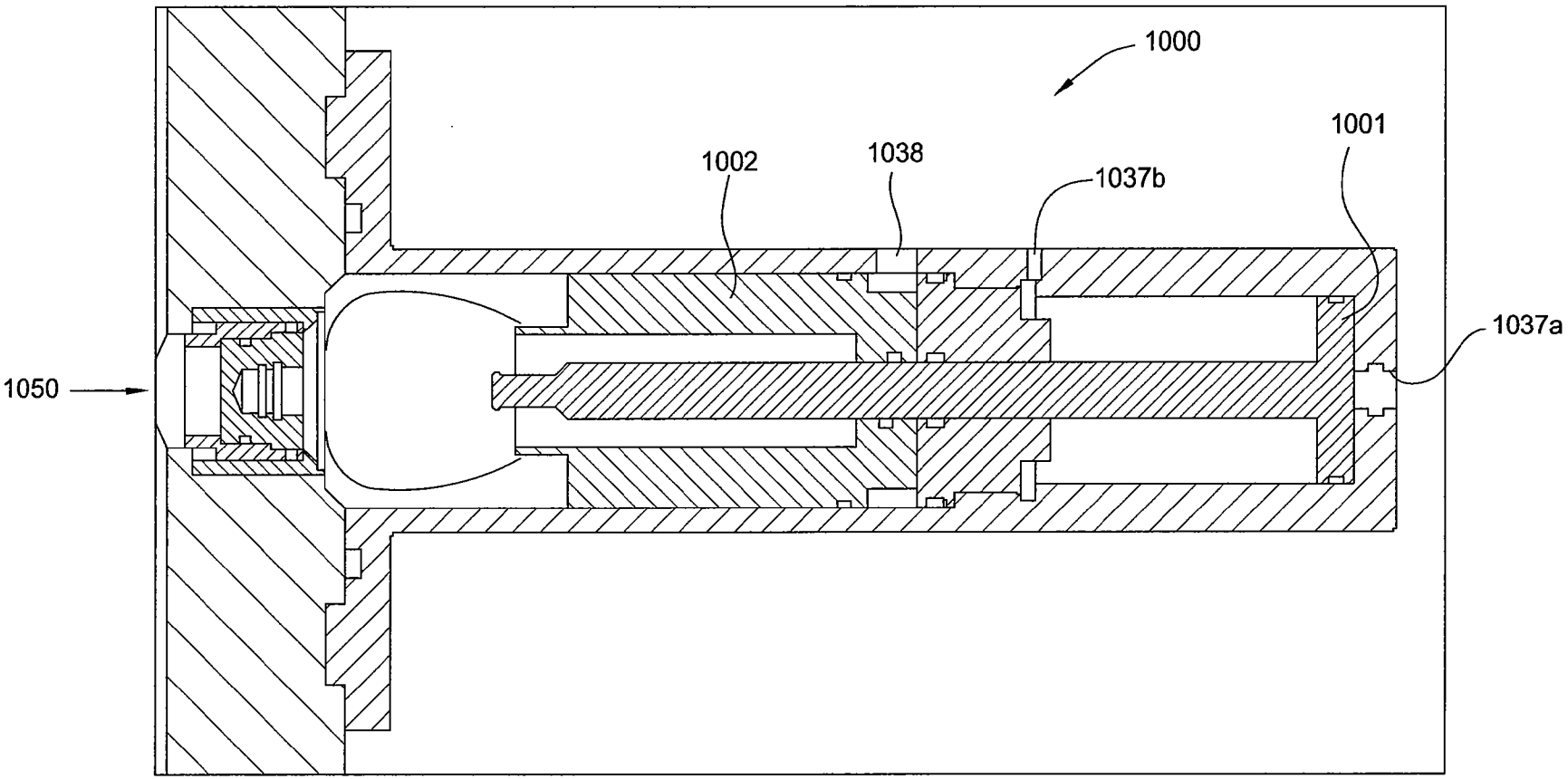
FIG. 10 is a cross-sectional view of a CFS plug and clamp, according to another embodiment of the present invention.
Figure 10A:
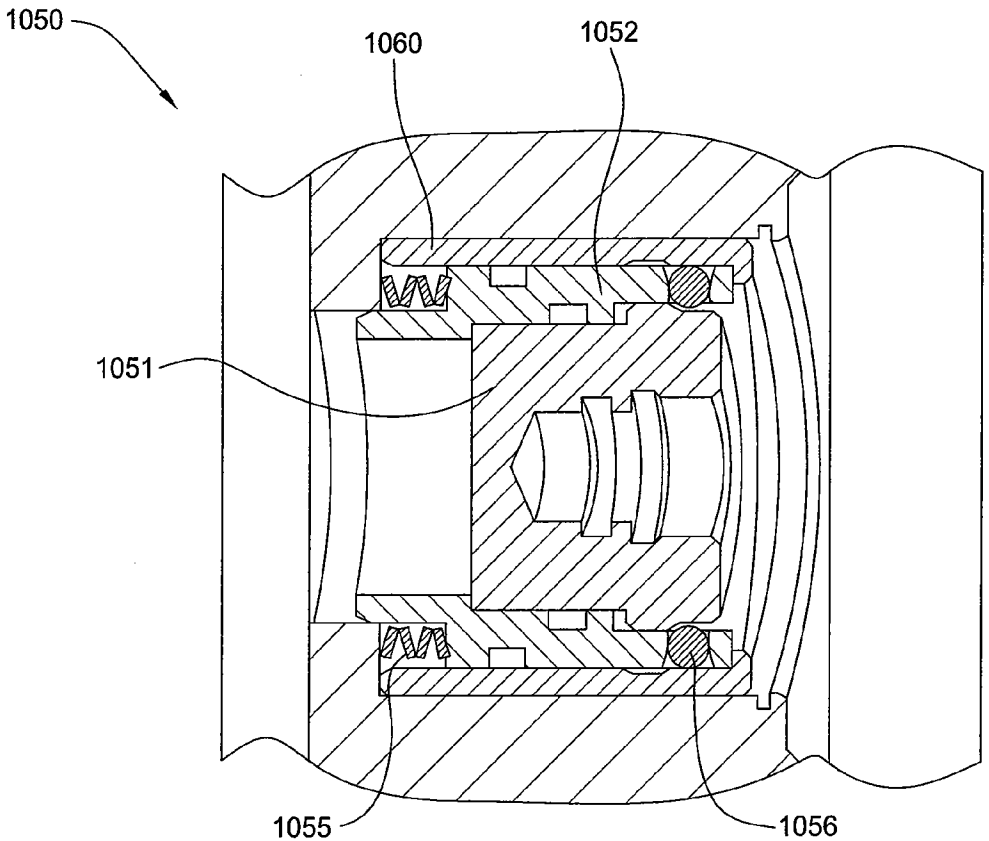
FIG. 10A is cross sectional view of the plug.

FIG. 10 is a cross-sectional view of a CFS plug 1050 and clamp 1000, according to another embodiment of the present invention. FIG. 10A is cross sectional view of the plug 1050. The plug 1050 may be used in a modified version of the port 201 of one of the CFSs housings 200, 700 instead of the plug 250 and the clamp 300 may be modified accordingly. Operational views of the plug and clamp may be found in FIGS. 5*a* -5*f* of the '434 provisional.

The plug 1050 may include an outer sleeve 1060, a locking sleeve 1052, a plurality of balls 1056, and a body 1051. A spring 1055 may be disposed between the locking sleeve and a shoulder formed in the CFS port wall and may bias the locking sleeve away from the shoulder. The balls and a shoulder formed in an inner surface of the locking sleeve may longitudinally couple the body to the locking sleeve. Seals may be disposed between interfaces of the CFS port wall/outer sleeve, outer sleeve/locking sleeve locking sleeve/body. The outer sleeve may be disposed between the CFS port wall shoulder and a snap ring disposed in a groove formed in the CFS port wall. A shoulder may be formed at an end of the outer sleeve to retain the locking sleeve.

The clamp 1000 may include an outer piston 1001 and an inner piston 1002. The clamp may further include an engagement port 1037*a* and a retrieval port 1037*b* in fluid communication with respective sides of the inner piston and a port 1038 in fluid communication with the outer piston. Alternatively, a spring may be used instead of the retrieval port. Hydraulic fluid may be injected into the engagement port, thereby pushing the inner piston toward the plug. A profile formed on an outer surface of the inner piston may engage a spring-biased latch, such as a snap ring, disposed in an inner surface of the body. Hydraulic fluid may be injected into the outer port, thereby pushing the outer piston toward the plug. An end of the outer piston may engage an end of the locking sleeve, thereby pushing the locking sleeve against the spring and moving the balls into a groove formed in an inner surface of the outer sleeve. Movement of the balls into the outer sleeve may disengage the balls from the body, thereby freeing the body. Hydraulic fluid may then be relieved from the engagement port and injected into the retrieval port, thereby moving the inner piston away from the CFS port and carrying the body. Hydraulic fluid may then be relieved from the outer piston port and drilling fluid pressure may push the outer piston away from the CFS port.

Once a joint/stand has been added/removed to/from the drill string, the plug may be installed. Hydraulic fluid may be injected into the engagement port, thereby pushing the inner piston and the body toward the CFS port until a profile formed on the outer surface of the body engages the balls, thereby pushing the locking sleeve until the balls move into the outer sleeve and allowing the body to pass. The spring may then return the locking sleeve and the balls until the balls re-engage the body. Hydraulic fluid may then be relieved from the engagement port and injected into the retrieval port, thereby moving the inner piston away from the plug.

Figure 11A:
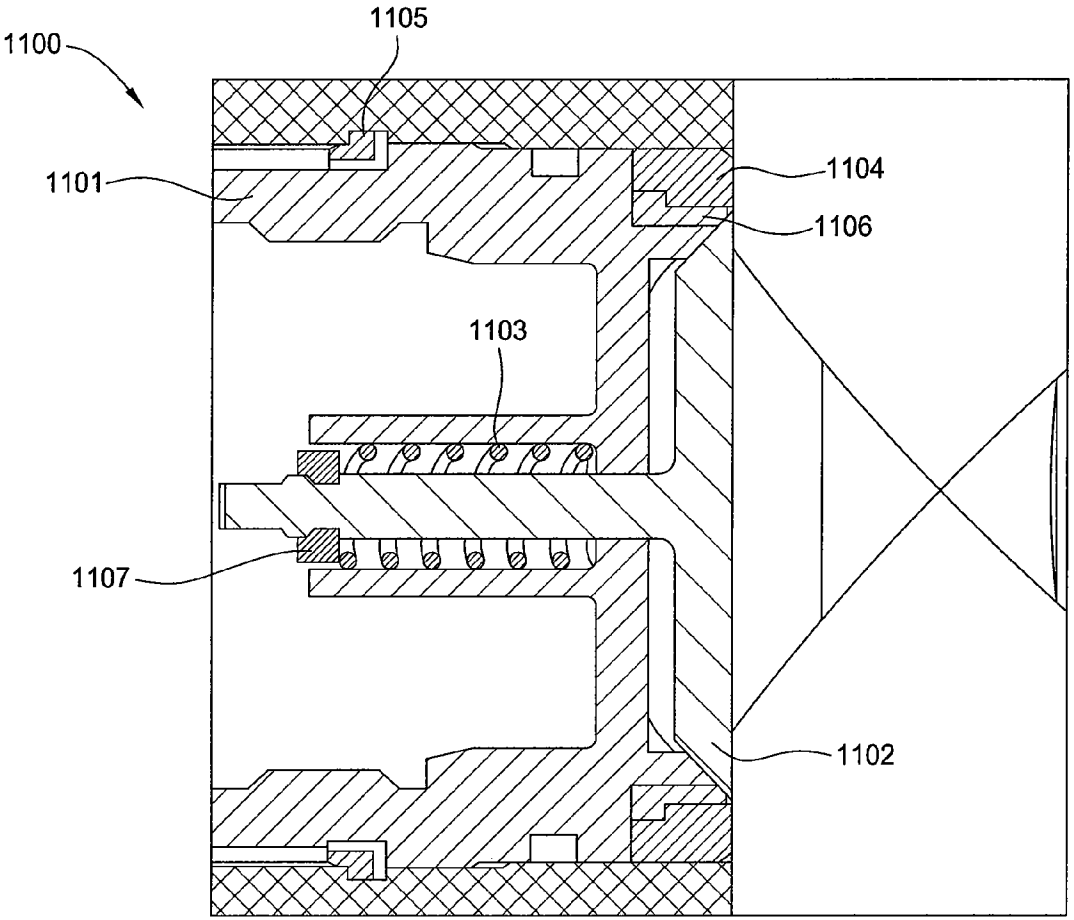
FIG. 11A is a cross-sectional view of a check valve installed in a CFS port, according to another embodiment of the present invention.

FIG. 11A is a cross-sectional view of a check valve 1100 installed in a CFS port, according to another embodiment of the present invention. The check valve may be used in a modified port of one of the CFSs 200, 700 instead of the plug 250.

The check valve 1100 may include a body 1101, a valve member, such as a poppet 1102, and a spring 1103 biasing the valve member toward a closed position. Alternatively, the valve member may be a flapper or ball. The body 1101 may be longitudinally coupled to the CFS port wall. The CFS port may include a shoulder. A seal retainer 1104 may seat against the shoulder. The body may include a recess formed in an outer surface thereof. A shoulder of the body recess may seat against the seal retainer. A snap ring 1105 may also be disposed between the body and the CFS port wall. The body 1101 may also be rotationally coupled to the CFS port wall. One or more grooves may be formed in an outer surface of the housing corresponding to respective grooves formed in the CFS port wall. Alignment of the grooves may form an opening for receiving a fastener. One of the grooves may be threaded so that the fastener may be a set screw. The grooves may extend to the snap ring so that the fastener may seat there-against. The body/CFS port interface may be sealed by a seal, such as an o-ring.

A shoulder may be formed an inner surface of the seal retainer 1104 and may receive a poppet seal 1106. An outer surface of the body recess may receive the poppet seal and the poppet seal may seat against the body recess shoulder. An end of the body may be inclined and may correspond to an inclined outer surface of the poppet body, thereby forming a seat for the poppet. Alternatively, a metal or alloy poppet seal may be used instead of a polymer seal. The metal or alloy seal may be compressed into a recess formed in the valve seat and may engage a modified spring retainer (see pg. 12 of '539 Provisional). Alternatively, the metal or alloy seal may have a B-shape cross-section (see FIG. 11D) having an outer loop retained by the seal retainer and an inner loop for engaging the poppet.

The body may have a solid outer wall, a solid inner wall, and one or more webs or spokes connecting the inner and outer walls and disposed in an annulus defined between the inner and outer walls. A bore may be formed through the body inner wall. The poppet may be disposed through the bore. The body inner wall may taper from a reduced diameter portion to an enlarged diameter portion and may form a shoulder between the portions. The spring may be disposed in the bore and seat against the inner wall shoulder. A nut 1107 may be disposed on an end of the poppet stem and connected thereto by threads. The spring may also seat against the nut, thereby biasing the poppet toward the poppet seat. The nut may be at least partially disposed in the inner wall bore. A portion of the valve stem (corresponding to a stroke length of the poppet) and the reduced bore portion may be polygonal, such as square, thereby rotationally coupling the valve stem and the body.

The check valve may be operable between an open position in response to external pressure exceeding internal pressure (plus spring pressure) and a closed position in response external pressure being less than or equal to internal pressure. From the closed position as shown, the poppet may move longitudinally away from the body and into the CFS bore until the poppet spring is fully compressed. Drilling fluid may then flow through the body annulus and into the CFS bore.

Figure 11B:
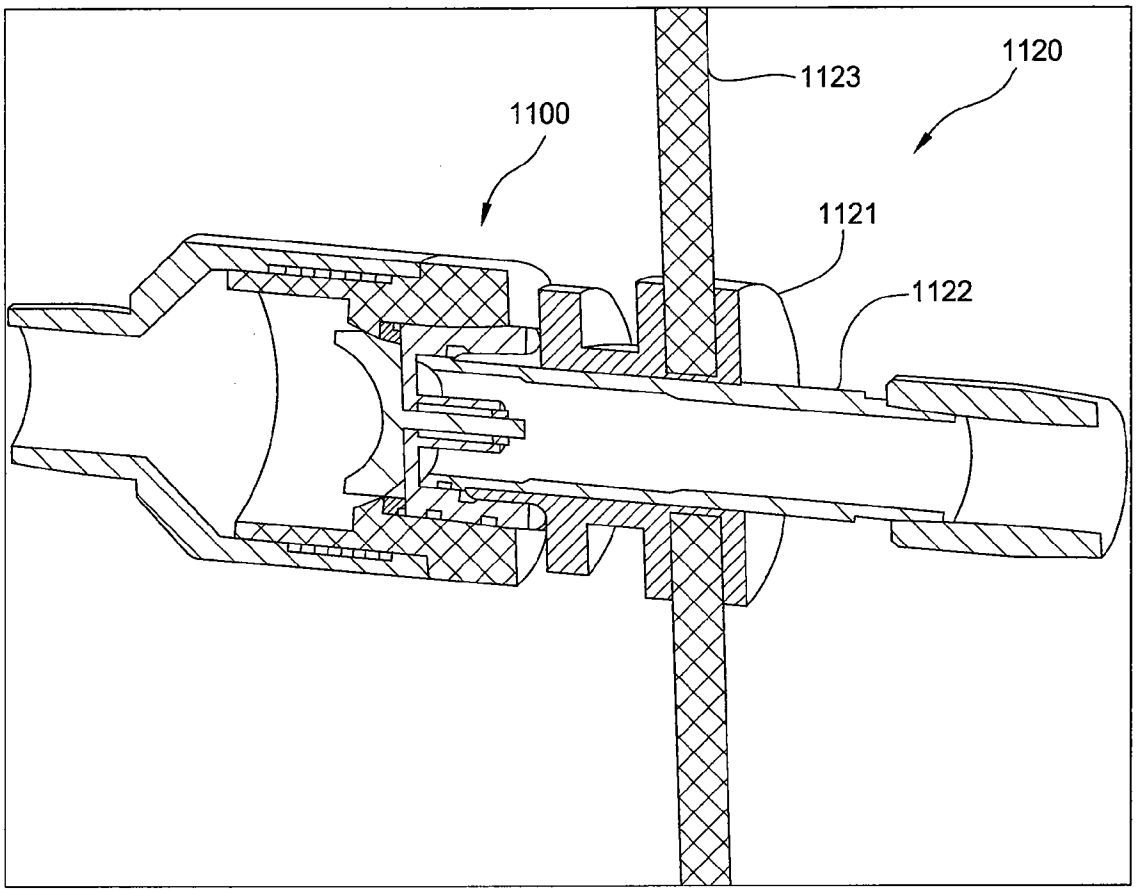
FIG. 11B is a cross-sectional view of a fluid coupling connected to the check valve.

FIG. 11B is a cross-sectional view of a fluid coupling 1120 connected to the check valve 1100. As shown, the check valve 1100 is installed in a test fixture. An inner surface of the body outer wall may form a profile for receiving a fluid coupling for connection to the mud pump outlet 29. The profile may include an enlarged diameter portion and a reduced diameter portion. The enlarged portion may be threaded and may include a shoulder for receiving a corresponding threaded flange of the coupling. The reduced portion may be smooth for receiving a seal, such as an o-ring for sealing an interface between the body and the coupling.

The fluid coupling 1120 may include a flange 1121 and a sleeve 1122. The sleeve may be disposed in the flange so that the flange may rotate relative to the sleeve. An outer surface of the sleeve may form a shoulder for retaining the sleeve. The flange may include one or more handles 1123 for manual rotation thereof by an operator. An outer surface of an end of the flange may be threaded and include a shoulder corresponding to the threaded portion of the body profile. Once a joint/stand is ready to be added/removed to/from the drill string, the coupling may be inserted into the check valve by an operator. The operator may then rotate the flange using the handles to make up the threaded connection between the flange and the body. A safety strap (not shown) may be fastened to the CFS housing and the flange. The outlet line may be connected to the sleeve and flow through the CFS port may commence.

Alternatively, a quick-connect nipple using one or more balls may connect the mud outlet 329 to the check valve by locking into a groove in the check valve body (see pgs. 15 and 16 of '539 Provisional). Alternatively, the outlet 329 may be attached to the body using a breech plug locking system that allows a nipple to be inserted into the body and rotated a fraction of a turn to be fully locked in place.

Alternatively, a modified version of the clamp 300 may be used to connect the outlet line 29 to the check valve. The modified clamp need not include the pistons 301, 302 and their associated components.

Alternatively, instead of connecting the outlet line 29 to the check valve, the outlet line 29 may be connected to a chamber between two annular BOPs, two pipe rams, or some combination of these. The BOPs and/or rams may engage the CFS and straddle the CFS port, thereby isolating the check valve and CFS port.

Figure 11C:
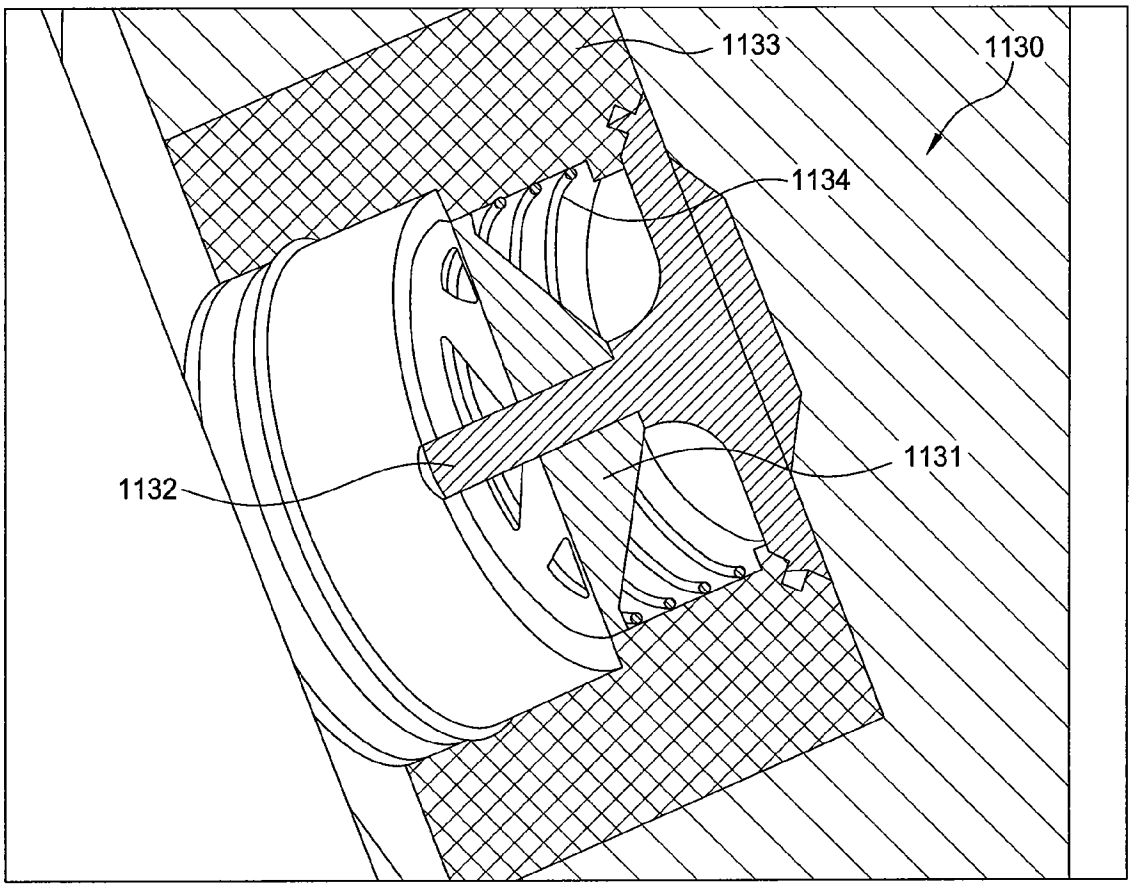
FIG. 11C is a perspective view of an alternative check valve.

FIG. 11C is a perspective view of an alternative check valve 1130. In this alternative, the inner wall and spokes of the body may be omitted. The poppet stem 1132 may instead be connected to a separate webbed poppet guide 1131 that may slide along an inner surface of the body 1133. The spring 1134 may be disposed between an end of an outer surface of the valve guide and a shoulder formed in an inner surface of the body. The guide may be rotationally coupled to the body, such as by a key and keyway.

Figure 11D:
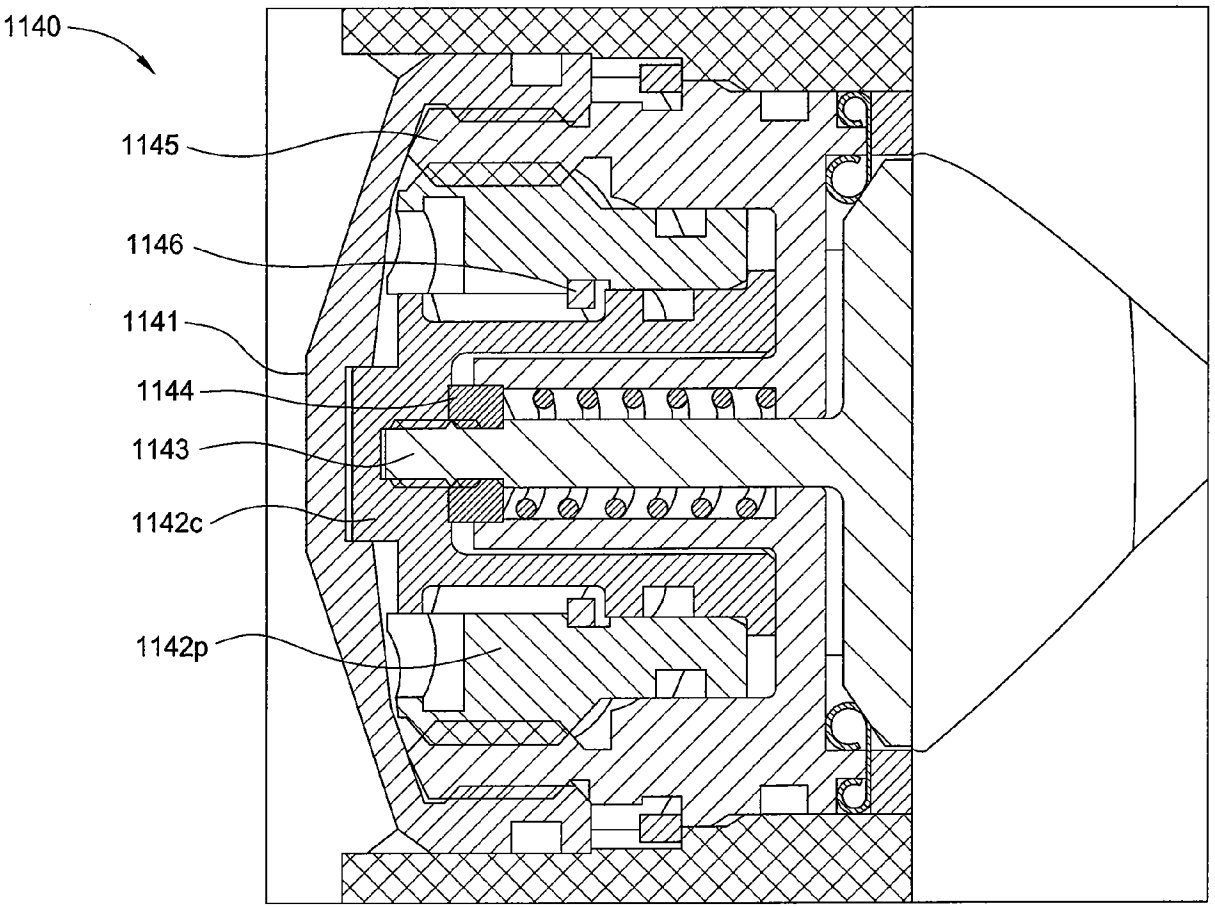
FIG. 11D is cross-sectional view of an alternative check valve having one or more failsafe mechanisms.

FIG. 11D is cross-sectional view of an alternative check valve 1140 having one or more failsafe mechanisms 1141, 1142. One or more of the failsafe mechanisms may also be used with the check valve 1100 of FIG. 11A. The failsafe mechanisms 1141, 1142 may include an internal cap 1142*c* and plug 1142*p* and/or an external cap 1141. The internal cap 1142*c* may thread onto the end of the valve stem 1143 behind the nut 1144. The internal cap 1142*c* may extend into the valve body 1145 and include a shoulder for engaging the webbed portion of the body to hold the poppet 1143 in the closed position. The internal cap may keep the valve stem from floating during circulation and may prevent valve erosion. A polygonal profile, such as hexagonal, may be formed on the end of the cap for allowing a wrench 1150 (see FIG. 11E) to engage the cap for makeup of the threaded connection with the valve stem. The internal cap may be installed in the valve body as a secondary seal and a seal for reverse pressure (higher pressure in the annulus than in the CFS bore).

The plug 1142*p* may have a threaded outer surface that may engage a threaded surface of the body profile. The plug may extend into the reduced diameter portion of the body profile and may include a seal, such as an o-ring, for sealing an interface therebetween. The internal cap may include a seal, such as an o-ring, for sealing an interface between the cap and the plug. A fastener, such as a snap ring 1146, may be disposed between the internal cap and the plug. The plug may retain the internal cap in the event of reverse pressure. The plug may include a profile, such as rotationally slotted, reverse counter-bored holes, for engagement with the wrench

1150. Engagement of the plug profile with the wrench may prevent dropping the internal cap/plug downhole.

The valve body 1145 may be modified for receiving the external cap 1141. The body may include a threaded outer recess for engaging a threaded internal surface of the external cap. The external cap may include a seal, such as an o-ring, for sealing an interface between the external cap and the CFS port wall. The external cap may include an internal shoulder for seating against a shoulder of the internal cap.

Figure 11E:
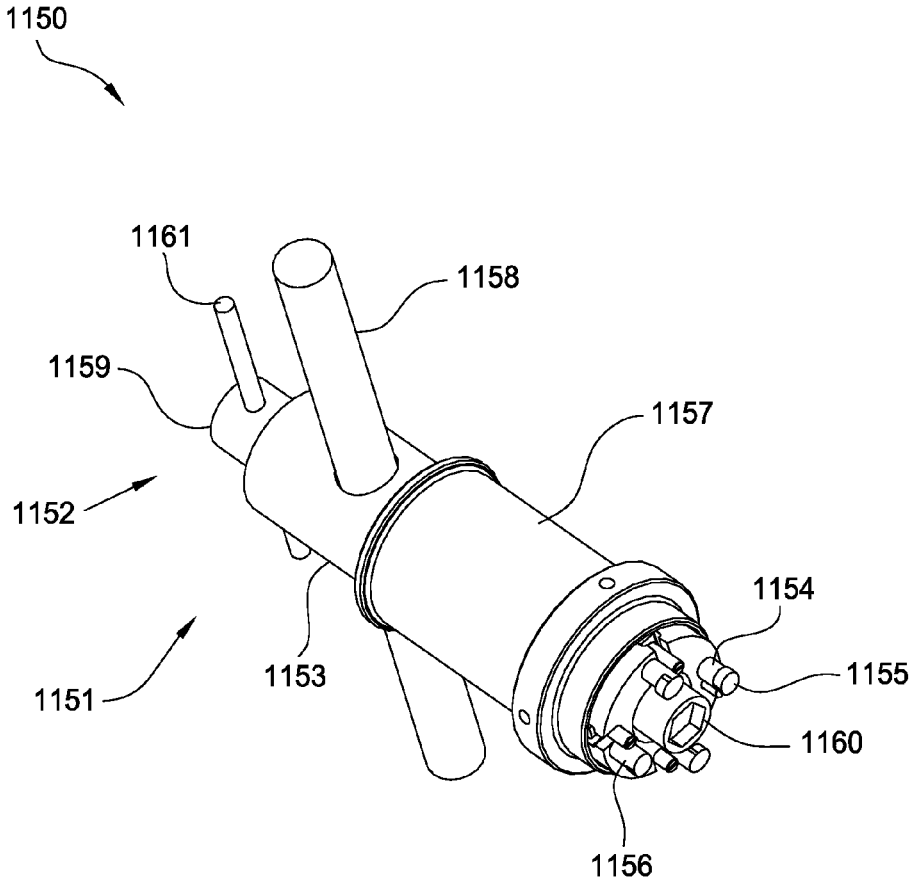
FIG. 11E is a perspective view of a wrench for removing or installing the internal cap and plug.

FIG. 11E is a perspective view of a wrench 1150 for removing or installing the internal cap 1142*c* and plug 1142*p*. The wrench 1150 may include an outer wrench 1151 for installing/removing the internal plug and an inner wrench 1152 coaxially disposed within the outer wrench for installing/removing the internal cap. The outer wrench 1151 may include a mandrel 1153 having protrusions 1154 extending from an end thereof. Each protrusion 1154 may include a foot 1155 formed thereon. The outer wrench may be rotated to slide the feet into the counterbores and pins 1156, behind each of the protrusions, may be inserted into the gaps in the slotted holes to lock the wrench and plug together. The pins may be pressed into spring loaded sliding blocks that slide in grooves in the outer wrench. A sleeve 1157 may be disposed along an outer surface of the outer wrench mandrel. The sleeve may tie the sliding blocks together with pins pressed through holes drilled in the sleeve into each of the sliding blocks. The sleeve may be retracted away from the plug, retracting the pins and allowing the outer wrench mandrel to be rotated and removed. A handle 1158 may be inserted through a radial opening formed through the mandrel opposite the protrusions.

The inner wrench 1152 may extend through a bore formed in the outer wrench and an opening formed through the outer wrench handle 1158. The inner wrench may include a rod 1159 that passes through the outer wrench mandrel and a socket 1160 on one end and a handle 1161 on the other end. The rod may be allowed to rotate and translate longitudinally relative to the outer wrench to be able to engage the hex profile on the internal cap with the socket and thread the internal cap onto the valve stem before using the outer wrench to make up the plug. The inner wrench may also retain the outer wrench handle. The inner wrench handle may be welded or pinned in place.

Figure 12:
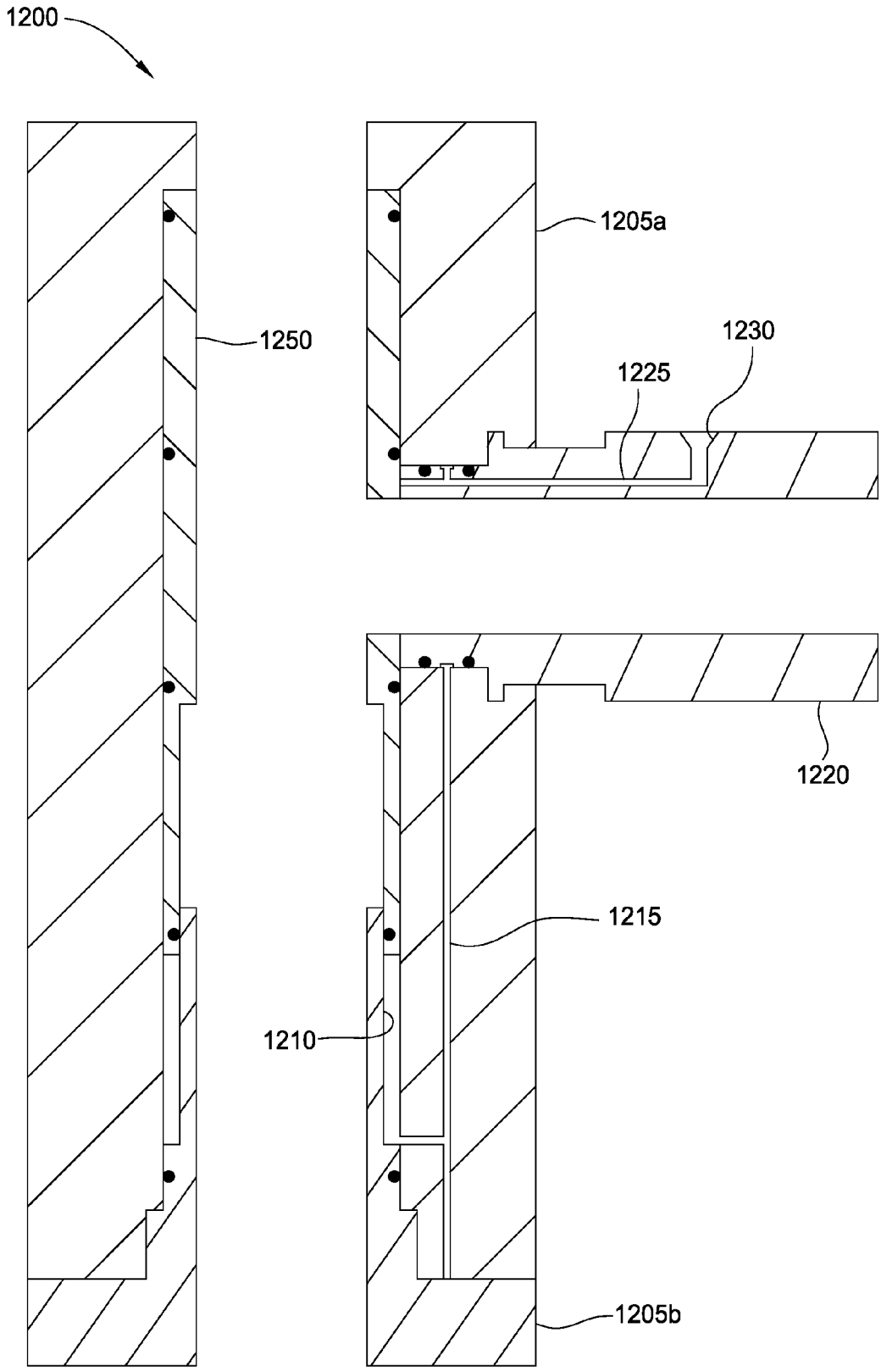
FIG. 12 is a cross-sectional view of a portion of a CFS, according to another embodiment of the present invention.

FIG. 12 is a cross-sectional view of a portion of a CFS 1200, according to another embodiment of the present invention. The CFS 1200 may be similar to one of the CFSs 200, 700 except for the substitution of a sliding sleeve valve 1250 for the plug 250 and accompanying modifications to the CFS housing 205, 705 (now 1205*a, b*). The CFS 1200 may include a first sub-housing 1205*a* and a second sub-housing 1205*b* longitudinally coupled by a threaded connection. The first sub-housing 1205*a* may include one of the float valves 210, 710 disposed therein, the radial port, and the sliding sleeve 1250 disposed therein. The sliding sleeve 1250 may include a radial port formed through a wall thereof corresponding to the housing port. The sliding sleeve may be longitudinally movable between an open position where the ports are aligned and a closed position where a wall of the sliding sleeve covers the port. One or more seals, such as o-rings, may be disposed between the sliding sleeve and the housing above and below the sliding sleeve port. The sliding sleeve may be operated by fluid pressure and may include a first longitudinal end in fluid communication with the housing bore and a second end in fluid communication with a hydraulic chamber 1210. The sliding sleeve may be rotationally coupled to the first sub-housing, such as by a key and keyway. One or more seals, such as o-rings, may be disposed between the sleeve and the housing proximate the first end of the sleeve.

The first sub-housing 1205*a* may have a recess formed therein at a second end thereof receiving the sleeve 1250. The second sub-housing 1205*b* may extend into the bore of the first sub-housing so that an outer surface thereof engages an inner surface of the sleeve. An interface therebetween may be sealed by one or more seals, such as o-rings. The hydraulic chamber 1210 may be an annulus formed between the sub-housings and a shoulder formed in an outer surface of the second sub-housing may define a longitudinal end of the hydraulic chamber. A seal, such as an o-ring, may be disposed between the sub-housings to seal the interface therebetween. A second end of the first sub-housing may seat against a shoulder formed in an outer surface of the second sub-housing and an interface therebetween may be sealed by a seal, such as an o-ring or a gasket, or a second end of the hydraulic passage may be threaded and receive a plug. A longitudinal hydraulic passage 1215 may be formed through the wall of the first sub-housing and extend to the housing port. A radial passage may be formed in the wall of the first sub-housing and may provide fluid communication between the hydraulic chamber and the hydraulic passage.

A flow nipple 1220 may be disposed in the housing port. The flow nipple 1220 may have a threaded outer surface for engaging a threaded inner surface of the port wall, thereby longitudinally coupling the flow nipple and the port wall. A longitudinal hydraulic passage 1225 may be formed through the wall of the flow nipple. A hydraulic port 1230 may be formed through the wall of the flow nipple in fluid communication with the hydraulic passage and may be threaded for receiving a hydraulic line. An end of the hydraulic passage may be threaded and may receive a plug. A radial hydraulic passage may be formed in the wall of the flow nipple and may provide fluid communication between the hydraulic port and the housing hydraulic passage via a groove formed in the outer surface of the flow nipple. One or more seals, such as o-rings, may seal, above and below, an interface between the flow nipple hydraulic passage and the housing port wall. When the flow nipple is removed, a plug may be inserted into the housing port.

In operation, when a joint or stand needs to be added to/removed from the drill string, the plug may be removed from the housing flow port. The flow nipple may be installed. A hydraulic line may then be connected to the hydraulic port in the flow nipple. Hydraulic fluid may then be injected into the hydraulic port. The hydraulic fluid may exert pressure on a second end of the sliding sleeve overcoming drilling fluid pressure exerted on the first end of the sliding sleeve, thereby moving the sleeve to the open position. Drilling fluid may then be injected into the flow nipple and the joint/stand added/removed to/from the drill string. Hydraulic fluid may then be relieved from the hydraulic port, thereby allowing the drilling fluid exerted on the first end of the sliding sleeve to close the sleeve. The flow nipple may then be removed and the plug may be replaced. Drilling may then resume.

In another embodiment (not shown), any of the CFS embodiments discussed above may be deployed as part of any of the annulus pressure control drilling systems (APCDSs) discussed and illustrated in U.S. Pat. App. Pub. No. 2008/0060846 , which is herein incorporate by reference in its entirety. The APCDS may include a drilling rig similar to the prior art drilling rig of FIG. 1. The APCDS may include the Kelly 4 or may include a top drive instead of the Kelly. The APCDS may further include an RCD (i.e., active or passive type) disposed on the wellhead for sealing against the drill string 8. If the wellbore is subsea, then the RCD may be disposed at the top of or within the riser if a riser is used for drilling or on the subsea wellhead having a returns line extending to the surface if riserless drilling is employed. Referring to the embodiments of FIGS. 8A-8E, the RCD may be omitted for the embodiments employing the annular seal 805*s*, 835*s* and other embodiments may already include the RCD 821.

The returns may be diverted by the RCD into an outlet line 23. An adjustable choke 40 and pressure sensor may be disposed in the returns outlet 23. The choke 40 and the pressure sensor may be in communication with a rig controller, such as the controller of FIG. 6A. One or more flow meters may also be disposed in the returns outlet. One or more separators, such as a gas separator and a solids shaker may be in communication with the returns outlet. A flare may be provided to vent the gas from the separator. A pressure sensor may be disposed in the casing 22 near a bottom thereof and in communication with the annulus. The pressure sensor may be in communication with the controller via a cable disposed along the casing or within a wall of the casing.

A downhole deployment valve (DDV) may be disposed in the casing near a bottom thereof. The casing pressure sensor may be integrated with the DDV. The drill string 8 may include a BHA disposed near the bit 20. The BHA may include a pressure sensor and a wireless (i.e., EM or mud pulse) telemetry sub or a cable extending through or along the drill pipe for providing communication between the pressure sensor and the controller.

In operation, the controller may input conventional drilling parameters, such as rig pump flow rate (from the flow meter FM), stand pipe pressure (SPP) (from sensor G1), well head pressure (WHP) (from the sensor in the returns outlet), torque exerted by the top drive (or rotary table), bit depth and/or hole depth, the rotational velocity of the drill string 105, and the upward force that the rig works exert on the drill string 8 (hook load). The drilling parameters may also include mud density, drill string dimensions, and casing dimensions.

Simultaneously, the controller may input a pressure measurement from the casing pressure sensor. The communication between the controller and the drilling parameters sources and the casing sensor may be high bandwidth and at light speed. From at least some of the drilling parameters, the controller may calculate an annulus flow model or pressure profile. The controller may then calibrate the annulus flow model using at least one of: the casing pressure measurement, the SPP measurement, and the WHP measurement. Using the calibrated annulus flow model, the controller may determine an annulus pressure at a desired depth, such as bottomhole.

The controller may compare the calculated annulus pressure to one or more formation threshold pressures (i.e., pore pressure or fracture pressure) to determine if a setting of the choke valve needs to be adjusted. Alternatively, the controller may instead alter the injection rate of drilling fluid and/or alter the density of the drilling fluid. Alternatively, the controller may determine if the calculated annulus pressure is within a window defined by two of the threshold pressures. If the choke setting needs to be adjusted, the controller may determine a choke setting that maintains the calculated annulus pressure within a desired operating window or at a desired level (i.e., greater than or equal to) with respect to the one or more threshold pressures at the desired depth. The controller may then send a control signal to the choke valve to vary the choke so that the calculated annulus pressure is maintained according to the desired program. The controller may iterate this process continuously (i.e., in real time). This is advantageous in that sudden formation changes or events (i.e., a kick) can be immediately detected and compensated for (i.e., by increasing the backpressure exerted on the annulus by the choke).

The controller may also input a BHP from the BHA sensor. Since this measurement may be transmitted using wireless telemetry, the measurement may be not available in real time. However, the BHP measurement may still be valuable especially as the distance between the casing sensor and the BH becomes significant. Since the desired depth may be below the casing sensor, the controller may extrapolate the calibrated flow model to calculate the desired depth. Regularly calibrating the annular flow model with the BHP may thus improve the accuracy of the annulus flow model.

During adding or removing joints or stands to/from the drill string and while injecting drilling fluid through the CFS port, the controller may also maintain the calculated annulus pressure with respect to the formation threshold pressure or window.

While the foregoing is directed to embodiments of the present invention, other and further embodiments of the invention may be devised without departing from the basic scope thereof, and the scope thereof is determined by the claims that follow.

The invention claimed is:

1. A method for drilling a wellbore, comprising:
drilling the wellbore by injecting drilling fluid into the wellbore and rotating a drill bit connected to a bottom of a first tubular string, wherein:
the first tubular string comprises:
a drill bit disposed on a bottom thereof,
tubular joints connected together,
a longitudinal bore therethrough,
a port through a wall thereof,
the drilling fluid exits the drill bit and carries cuttings from the drill bit, and
the cuttings and drilling fluid (returns) flow to surface; and
injecting drilling fluid into a first annulus formed between the first tubular string and a second tubular string while adding a tubular joint or stand of joints to the first tubular string, wherein:
the drilling fluid is diverted into the port and through the first tubular string by a seal disposed in the first annulus, and
the returns are diverted into a second annulus or third tubular string by the seal.

2. The method of claim 1, wherein the drilling fluid is injected into the wellbore via a top of the tubular string.

3. The method of claim 2, wherein:
the first tubular string comprises the seal,
the seal is directional, and
the seal is disengaged from the second tubular string during drilling, and
the seal engages the second tubular string in response to injecting drilling fluid into the first annulus.

4. The method of claim 1, wherein the drilling fluid is injected into the wellbore via the first annulus.

5. The method of claim 1, wherein the first tubular string further comprises:
a float valve disposed in the bore, and
a check valve disposed in the port.

6. The method of claim 1, wherein the first tubular string further comprises:
a sleeve disposed around one of the joints below the port,
a bearing disposed between the sleeve and the one joint so that the sleeve may rotate relative to the one joint, wherein
the seal is disposed around the sleeve.

7. The method of claim 1, wherein the second tubular string is a tie back casing string.

8. The method of claim 1, wherein the second tubular string is a riser string.

9. The method of claim 8, wherein the seal is part of a rotating control device connected to a subsea wellhead.

10. A method for drilling a wellbore, comprising:

drilling the wellbore by injecting drilling fluid into a top of a tubular string disposed in the wellbore at a first flow rate and rotating a drill bit, wherein:

the tubular string comprises:

the drill bit disposed on a bottom thereof, tubular joints connected together, a longitudinal bore therethrough, and a port through a wall thereof, the port is closed, the drilling fluid exits the drill bit and carries cuttings from the drill bit, and the cuttings and drilling fluid (returns) flow to surface via an annulus defined between the tubular string and the wellbore;

engaging the tubular string with a clamp, the clamp isolating the port from an exterior of the tubular string;

operating an actuator to remove a plug from the port after engaging the clamp, thereby opening the port;

injecting drilling fluid into the port at a second flow rate while adding a tubular joint or stand of joints to the tubular string, wherein injection of drilling fluid into the tubular string is continuously maintained between drilling and adding the joint or stand to the tubular string; and operating the actuator to install the plug into the port, thereby closing the port; and disengaging the clamp from the tubular string after closing the port, wherein the first flow rate is greater than the second flow rate.

11. The method of claim 10, wherein:

the clamp comprises:

a body having a seal for engaging the port, one or more bands hinged to the body, a latch operable to connect the bands to the body, a tensioner operable to tightly engage the body and the bands around an outer surface of the tubular string, and an inlet for injecting fluid into the port, and the actuator comprises:

a first piston disposed in the body and having a latch operable to engage the plug, thereby coupling the first piston and the latch, and a second piston disposed in the body and operable to retain the plug so that the first piston latch may disengage from the plug.

12. The method of claim 10, wherein the tubular string further comprises a float valve disposed in the bore above the port.

13. The method of claim 10, wherein the added joint or stand includes a longitudinal bore and a port through a wall thereof.

14. The method of claim 10, wherein the stand of joints is added to the tubular string, and the tubular string comprises ports spaced apart by a length of the stand.

15. The method of claim 10, further comprising:

engaging the tubular string with a rotating control device (RCD), wherein a variable choke valve is disposed in an outlet line in fluid communication with the RCD; and controlling pressure of the returns using the variable choke valve.

16. The method of claim 10, wherein the tubular string further comprises a first centralizer or stabilizer located proximate to the port.

17. The method of claim 16, wherein:

the first centralizer or stabilizer is located proximately above the port, and the tubular string further comprises a second centralizer or stabilizer located proximately below the port.

18. The method of claim 16, wherein at least a portion of the first centralizer or stabilizer is capable of rotating independently of the tubular joints.

19. A method for drilling a wellbore, comprising:

drilling the wellbore by injecting drilling fluid into a top of a tubular string disposed in the wellbore at a first flow rate and rotating a drill bit, wherein:

the tubular string comprises:

the drill bit disposed on a bottom thereof, tubular joints connected together, a longitudinal bore therethrough, and a port through a wall thereof, the port is closed, the drilling fluid exits the drill bit and carries cuttings from the drill bit, and the cuttings and drilling fluid (returns) flow to surface via an annulus defined between the tubular string and the wellbore;

engaging the tubular string with a clamp, the clamp isolating the port from an exterior of the tubular string;

operating an actuator to remove a plug from the port after engaging the clamp, thereby opening the port;

injecting drilling fluid into the port at a second flow rate while adding a tubular joint or stand of joints to the tubular string, wherein injection of drilling fluid into the tubular string is continuously maintained between drilling and adding the joint or stand to the tubular string; and operating the actuator to install the plug into the port, thereby closing the port; and disengaging the clamp from the tubular string after closing the port, wherein:

the clamp comprises:

a body having a seal for engaging the port, one or more bands hinged to the body, a latch operable to connect the bands to the body, a tensioner operable to tightly engage the body and the bands around an outer surface of the tubular string, and an inlet for injecting fluid into the port, and the actuator comprises:

a first piston disposed in the body and having a latch operable to engage the plug, thereby coupling the first piston and the latch, and a second piston disposed in the body and operable to retain the plug so that the first piston latch may disengage from the plug.

20. A method for drilling a wellbore, comprising:

drilling the wellbore by injecting drilling fluid into a top of a tubular string disposed in the wellbore at a first flow rate and rotating a drill bit, wherein:

the tubular string comprises:

the drill bit disposed on a bottom thereof, tubular joints connected together, a longitudinal bore therethrough, a port through a wall thereof, and a float valve disposed in the bore above the port the port is closed, the drilling fluid exits the drill bit and carries cuttings from the drill bit, and the cuttings and drilling fluid (returns) flow to surface via an annulus defined between the tubular string and the wellbore;

engaging the tubular string with a clamp, the clamp isolating the port from an exterior of the tubular string;

operating an actuator to remove a plug from the port after engaging the clamp, thereby opening the port;

injecting drilling fluid into the port at a second flow rate while adding a tubular joint or stand of joints to the tubular string, wherein injection of drilling fluid into the tubular string is continuously maintained between drilling and adding the joint or stand to the tubular string; and operating the actuator to install the plug into the port, thereby closing the port; and disengaging the clamp from the tubular string after closing the port.

21. A method for drilling a wellbore, comprising:

drilling the wellbore by injecting drilling fluid into a top of a tubular string disposed in the wellbore at a first flow rate and rotating a drill bit, wherein:

the tubular string comprises:

the drill bit disposed on a bottom thereof, tubular joints connected together, a longitudinal bore therethrough, and a port through a wall thereof, the port is closed, the drilling fluid exits the drill bit and carries cuttings from the drill bit, and the cuttings and drilling fluid (returns) flow to surface via an annulus defined between the tubular string and the wellbore;

engaging the tubular string with a clamp, the clamp isolating the port from an exterior of the tubular string;

operating an actuator to remove a plug from the port after engaging the clamp, thereby opening the port;

injecting drilling fluid into the port at a second flow rate while adding a tubular joint or stand of joints to the tubular string, wherein injection of drilling fluid into the tubular string is continuously maintained between drilling and adding the joint or stand to the tubular string; and operating the actuator to install the plug into the port, thereby closing the port; and disengaging the clamp from the tubular string after closing the port, wherein the first flow rate is equal to or substantially equal to the second flow rate.

22. A method for drilling a wellbore, comprising:

drilling the wellbore by injecting drilling fluid into a top of a tubular string disposed in the wellbore at a first flow rate and rotating a drill bit, wherein:

the tubular string comprises:

the drill bit disposed on a bottom thereof, tubular joints connected together, a longitudinal bore therethrough, and a port through a wall thereof, the port is closed, the drilling fluid exits the drill bit and carries cuttings from the drill bit, and the cuttings and drilling fluid (returns) flow to surface via an annulus defined between the tubular string and the wellbore;

engaging the tubular string with a clamp, the clamp isolating the port from an exterior of the tubular string;

operating an actuator to remove a plug from the port after engaging the clamp, thereby opening the port;

injecting drilling fluid into the port at a second flow rate while adding a tubular joint or stand of joints to the tubular string, wherein injection of drilling fluid into the tubular string is continuously maintained between drilling and adding the joint or stand to the tubular string; and operating the actuator to install the plug into the port, thereby closing the port; and disengaging the clamp from the tubular string after closing the port, wherein the added joint or stand includes a longitudinal bore and a port through a wall thereof.

23. A method for drilling a wellbore, comprising:

drilling the wellbore by injecting drilling fluid into a top of a tubular string disposed in the wellbore at a first flow rate and rotating a drill bit, wherein:

the tubular string comprises:

the drill bit disposed on a bottom thereof, tubular joints connected together, a longitudinal bore therethrough, and ports through a wall thereof and spaced apart by a length of a stand of joints, the ports are closed, the drilling fluid exits the drill bit and carries cuttings from the drill bit, and the cuttings and drilling fluid (returns) flow to surface via an annulus defined between the tubular string and the wellbore;

engaging the tubular string with a clamp, the clamp isolating one of the ports from an exterior of the tubular string;

operating an actuator to remove a plug from the one port after engaging the clamp, thereby opening the one port;

injecting drilling fluid into the one port at a second flow rate while adding the stand of joints to the tubular string, wherein injection of drilling fluid into the tubular string is continuously maintained between drilling and adding the stand to the tubular string; and operating the actuator to install the plug into the one port, thereby closing the one port; and disengaging the clamp from the tubular string after closing the one port.

24. A method for drilling a wellbore, comprising:

drilling the wellbore by injecting drilling fluid into a top of a tubular string disposed in the wellbore at a first flow rate and rotating a drill bit, wherein:

the tubular string comprises:

the drill bit disposed on a bottom thereof, tubular joints connected together, a longitudinal bore therethrough, and a port through a wall thereof, the port is closed, the drilling fluid exits the drill bit and carries cuttings from the drill bit, and the cuttings and drilling fluid (returns) flow to surface via an annulus defined between the tubular string and the wellbore;

engaging the tubular string with a clamp, the clamp isolating the port from an exterior of the tubular string;

operating an actuator to remove a plug from the port after engaging the clamp, thereby opening the port;

injecting drilling fluid into the port at a second flow rate while adding a tubular joint or stand of joints to the tubular string, wherein injection of drilling fluid into the tubular string is continuously maintained between drilling and adding the joint or stand to the tubular string; and operating the actuator to install the plug into the port, thereby closing the port;

disengaging the clamp from the tubular string after closing the port;

engaging the tubular string with a rotating control device (RCD), wherein a variable choke valve is disposed in an outlet line in fluid communication with the RCD; and controlling pressure of the returns using the variable choke valve.

25. A method for drilling a wellbore, comprising:

drilling the wellbore by injecting drilling fluid into a top of a tubular string disposed in the wellbore at a first flow rate and rotating a drill bit, wherein:

the tubular string comprises:

the drill bit disposed on a bottom thereof, tubular joints connected together, a longitudinal bore therethrough, a port through a wall thereof, and a first centralizer or stabilizer located proximate to the port, the port is closed, the drilling fluid exits the drill bit and carries cuttings from the drill bit, and the cuttings and drilling fluid (returns) flow to surface via an annulus defined between the tubular string and the wellbore;

engaging the tubular string with a clamp, the clamp isolating the port from an exterior of the tubular string;

operating an actuator to remove a plug from the port after engaging the clamp, thereby opening the port;

injecting drilling fluid into the port at a second flow rate while adding a tubular joint or stand of joints to the tubular string, wherein injection of drilling fluid into the tubular string is continuously maintained between drilling and adding the joint or stand to the tubular string; and operating the actuator to install the plug into the port, thereby closing the port; and disengaging the clamp from the tubular string after closing the port.

26. The method of claim 25, wherein:

the first centralizer or stabilizer is located proximately above the port, and the tubular string further comprises a second centralizer or stabilizer located proximately below the port.

27. The method of claim 25, wherein at least a portion of the first centralizer or stabilizer is capable of rotating independently of the tubular joints.

* * * * *